US007822351B2

(12) United States Patent
Aoki et al.

(10) Patent No.: US 7,822,351 B2
(45) Date of Patent: Oct. 26, 2010

(54) FILLING-RATE LOWERING AND ROLLING RATE ADJUSTING IMAGE FORMING APPARATUS

(75) Inventors: Katsuhiro Aoki, Kanagawa (JP); Takeo Tsukamoto, Kanagawa (JP); Takashi Fujita, Kanagawa (JP); Yasuyuki Ishii, Tokyo (JP); Katsuaki Miyawaki, Kanagawa (JP); Masanori Saitoh, Tokyo (JP); Kei Yasutomi, Kanagawa (JP); Hitoshi Maruyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 133 days.

(21) Appl. No.: 12/209,812

(22) Filed: Sep. 12, 2008

(65) Prior Publication Data

US 2009/0074431 A1 Mar. 19, 2009

(30) Foreign Application Priority Data

Sep. 14, 2007 (JP) ..... 2007-240248

(51) Int. Cl.
*G03G 15/00* (2006.01)
*G03G 15/08* (2006.01)

(52) U.S. Cl. ..... 399/46; 399/49; 399/53; 399/69; 399/307; 399/291

(58) Field of Classification Search ..... 399/307, 399/67, 68, 69, 49, 53, 55, 291, 46
See application file for complete search history.

(56) References Cited

U.S. PATENT DOCUMENTS 5,339,141 A 8/1994 Suzuki et al.
5,424,814 A 6/1995 Suzuki et al.
5,438,401 A 8/1995 Murayama et al.
5,456,782 A 10/1995 Fujita et al.
5,565,973 A 10/1996 Fujishiro et al.
5,783,288 A 7/1998 Fujita et al.
6,163,669 A 12/2000 Aoki et al.
6,295,437 B1 9/2001 Hodoshima et al.
6,366,751 B1 4/2002 Shakuto et al.
6,463,244 B2 10/2002 Aoki et al.

(Continued)

FOREIGN PATENT DOCUMENTS

JP 8-3673 (B2) 1/1996

(Continued)

OTHER PUBLICATIONS

U.S. Appl. No. 07/987,815, filed Dec. 9, 1992, Hisao Murayama et al.

(Continued)

*Primary Examiner*—Sophia S Chen
(74) *Attorney, Agent, or Firm*—Oblon, Spivak, McClelland, Maier & Neustadt, L.L.P.

(57) ABSTRACT

An image forming apparatus includes a toner-layer filling-rate lowering unit that causes a toner layer of toner images to be formed on an image carrier so that the toner layer has sufficient optical transparency for exposing and the toner-layer filling rate is set relatively low; and a toner rolling rate adjusting unit that rolls the toner images at a predetermined toner rolling rate in accordance with the toner-layer filling rate when the toner images are transferred to the transferring/fixing unit.

20 Claims, 16 Drawing Sheets

U.S. PATENT DOCUMENTS

| | | | | |
|---|---|---|---|---|
| 6,505,014 | B2 | 1/2003 | Aoki et al. | |
| 6,526,248 | B1 | 2/2003 | Aoki et al. | |
| 6,608,984 | B1 | 8/2003 | Matsumoto et al. | |
| 6,625,409 | B2 | 9/2003 | Shakuto et al. | |
| 6,654,579 | B2 | 11/2003 | Shakuto et al. | |
| 6,658,227 | B2 | 12/2003 | Oyama et al. | |
| 6,721,516 | B2 | 4/2004 | Aoki et al. | |
| 6,757,509 | B2 | 6/2004 | Shoji et al. | |
| 6,785,490 | B2 | 8/2004 | Tsukamoto et al. | |
| 6,819,901 | B1 | 11/2004 | Yasutomi et al. | |
| 6,901,233 | B2 | 5/2005 | Aoki et al. | |
| 6,978,109 | B2 | 12/2005 | Shoji et al. | |
| 7,035,575 | B2 | 4/2006 | Ikeguchi et al. | |
| 2002/0081128 | A1 | 6/2002 | Shakuto et al. | |
| 2002/0090229 | A1 | 7/2002 | Shakuto et al. | |
| 2002/0191988 | A1* | 12/2002 | Oooka | 399/307 X |
| 2006/0188274 | A1 | 8/2006 | Yasutomi | |
| 2006/0198663 | A1 | 9/2006 | Miyoshi et al. | |
| 2007/0015071 | A1 | 1/2007 | Tsukamoto et al. | |
| 2007/0041738 | A1* | 2/2007 | Ide | 399/49 X |
| 2007/0071511 | A1* | 3/2007 | Suzuki et al. | 399/307 |
| 2007/0160395 | A1 | 7/2007 | Kosugi et al. | |
| 2007/0212121 | A1 | 9/2007 | Takahashi et al. | |
| 2007/0242985 | A1 | 10/2007 | Aoki et al. | |
| 2008/0089720 | A1 | 4/2008 | Tsukamoto et al. | |
| 2008/0089723 | A1 | 4/2008 | Tsukamoto et al. | |
| 2008/0124138 | A1 | 5/2008 | Kosugi et al. | |
| 2008/0219718 | A1* | 9/2008 | Fujita et al. | 399/307 |
| 2009/0080920 | A1* | 3/2009 | Carter et al. | 399/49 |

FOREIGN PATENT DOCUMENTS

| | | |
|---|---|---|
| JP | 3250851 (B2) | 11/2001 |

OTHER PUBLICATIONS

U.S. Appl. No. 07/966,508, filed Oct. 23, 1992, Takashi Fujita et al.
U.S. Appl. No. 08/423,046, filed Apr. 17, 1995, Takashi Fujita et al.

* cited by examiner

FILLING-RATE LOWERING AND ROLLING RATE ADJUSTING IMAGE FORMING APPARATUS

CROSS-REFERENCE TO RELATED APPLICATIONS

The present application claims priority to and incorporates by reference the entire contents of Japanese priority document 2007-240248 filed in Japan on Sep. 14, 2007.

BACKGROUND OF THE INVENTION

1. Field of the Invention

The present invention relates to an image forming apparatus.

2. Description of the Related Art

A multicolor image forming apparatus such as a copier, a facsimile, a printer, a plotter, a multifunctional peripheral (MFP), or the like is known, in which toner images of at least two colors are superimposed on a single photosensitive element by using developers of at least two colors through repeating charging and exposing the photosensitive element to form a latent image thereon and developing the latent image, thereby forming a color image. Such multicolor image forming apparatus is disclosed, for example, in Japanese Patent No. 3250851 and Japanese Published Examined Patent Application No. H08-3673.

Recently, a demand for a full-color image forming apparatus has been increasing along with remarkable improvement in quality and cost reduction of color images as above including full-color images that are realized by forming toner images on a single photosensitive element in a superimposing manner (superimposing development). When a color image is formed by using a single photosensitive element in the above manner, the number of times of transferring can be reduced, which results in reducing possibility of degradation of image quality. Moreover, the number of photosensitive elements can be reduced, so that the size of the apparatus can be reduced by the space for the reduced photosensitive elements, thereby reducing the cost for manufacturing the apparatus.

For the conventional superimposing development process, various methods have been proposed to reduce and compensate influence of a toner layer already developed on a photosensitive element.

In the technology disclosed in Japanese Patent No. 3250851, when a plurality of toner images of different colors is formed on a photosensitive element, a charge potential for forming a first color toner image is made different from that for a second color toner image, and a surface potential of the photosensitive element in a portion on which a toner image is formed is made lower than that in a portion on which the toner image is not formed, i.e., a charge potential forming condition is changed, thereby preventing undesired color mixture of toner.

In the technology disclosed in Japanese Published Examined Patent Application No. H08-3673, the thickness of a photosensitive element, a toner layer already formed on the photosensitive element, and a toner layer on a developer carrier (toner carrier), and their relationship are defined, and a developing condition is set to suppress discharging in consideration of color turbidity of an image and color mixture of toner in a developing unit due to reverse transfer.

However, in the technology of Japanese Patent No. 3250851, the toner layer potential increases by superimposing toner images of four colors, so that a developing potential between a toner-layer formed area and a toner-layer non-formed area becomes different, thereby changing image density and hue.

Moreover, in the technology of Japanese Published Examined Patent Application No. H08-3673, when toner images of four colors are superimposed on the photosensitive element, it is expected that the change of a developing potential by the potential of a previously formed toner layer when the thickness of the toner layer increases causes image density and hue to change.

In the image forming apparatus in which toner images of different colors are formed on a single image carrier (photosensitive element) in a superimposing manner as described above, when a toner layer on the image carrier is too thick, the toner images are difficult to superimpose in the developing process due to toner layer potential and light shielding effect. Therefore, the toner layer potential needs to be reduced, and the optical transparency needs to be ensured.

To cope with the above problems, the inventors have reached a conception of an image forming apparatus in which multicolor toner image forming process by using a multicolor toner image forming unit and a transferring/fixing process by using a transferring/fixing unit or the like for simultaneously performing transferring and fixing of a color image are organically combined.

As a result of vigorous investigation, the inventors have achieved a toner-layer filling-rate lowering unit that keeps the toner-layer filling rate of toner on the photosensitive element to relatively low to develop a color toner image while securing the optical transparency in exposure and a transferring/fixing unit that causes a uniform image to be formed in the state where the toner-layer filling rate is relatively low in the transferring and fixing process, i.e., a toner rolling rate adjusting unit that rolls superimposed multicolor toner images with a predetermined toner rolling rate. Therefore, appropriate developing potential can be ensured in the image forming process for the second and successive colors.

In the present invention, a multicolor toner image is formed on the photosensitive element in a state where the toner-layer filling rate is set relatively low that is insufficient for a typical image to obtain sufficient optical transparency in exposure, and the formed multicolor toner image is rolled at a predetermined toner rolling rate by utilizing the toner rolling effect in the transferring and fixing process to compensate the insufficient toner adhering amount. This is different from the conventional technology in which toner with relatively high density is used for forming a multicolor toner image.

SUMMARY OF THE INVENTION

It is an object of the present invention to at least partially solve the problems in the conventional technology.

According to an aspect of the present invention, there is provided an image forming apparatus including an image carrier that carries an image; a toner image forming unit that includes a charging unit, an exposing unit, and a developing unit, and forms a color toner image on the image carrier by superimposing toner images of at least two colors thereon by using developers of at least two colors through repeating charging and exposing of the image carrier by the charging unit and the exposing unit to form a latent image thereon and developing the latent image by the developing unit; a transferring/fixing unit that comes into contact with the image carrier carrying the color toner image so that the color toner image is transferred onto the transferring/fixing unit; a pressing unit that is in pressure-contact with the transferring/fixing unit to form a nip through which a recording medium is conveyed; and a heating unit that heats the transferring/fixing unit and the recording medium.

According to another aspect of the present invention, there is provided an image forming method including forming a color toner image on an image carrier by superimposing toner images of at least two colors thereon by using developers of at least two colors through repeating charging and exposing of the image carrier by a charging unit and an exposing unit to form a latent image thereon and developing the latent image by a developing unit; and transferring the color toner image from the image carrier to a transferring/fixing unit by at least one of heat and pressure.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
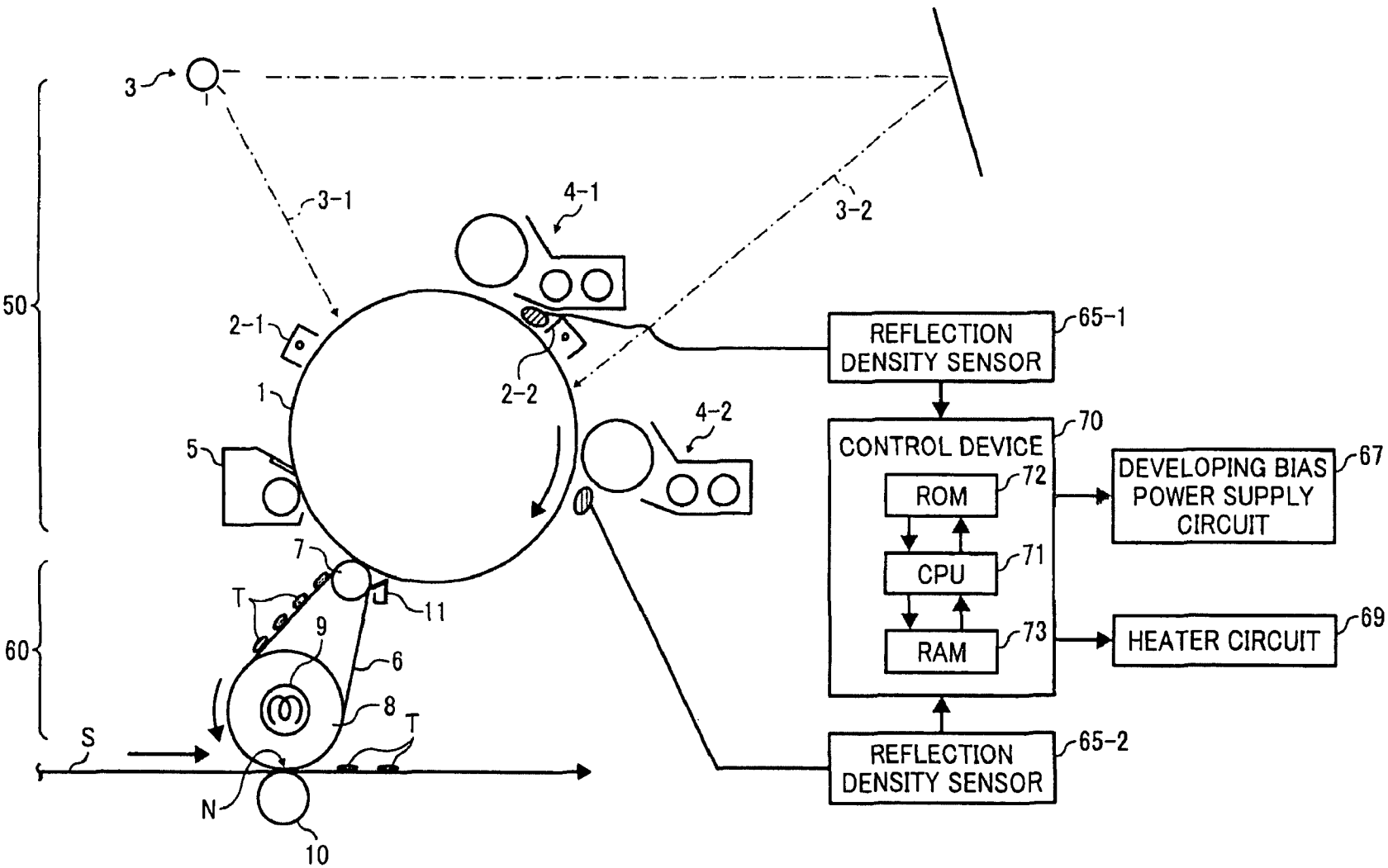
FIG. 1 is a schematic diagram of an image forming apparatus according to an embodiment of the present invention.

FIG. 1 is a schematic diagram of an image forming apparatus such as a copier according to an embodiment of the present invention. The image forming apparatus includes a toner image forming device 50, a transferring/fixing device 60, and a control device 70. The toner image forming device 50 uses developers of at least two colors, and forms a multicolor toner image on a single drum-shaped photosensitive element 1 as an image carrier by superimposing toner images of at least two colors thereon through repeating charging and exposing the photosensitive element 1 to form a latent image thereon and developing the latent image. The transferring/fixing device 60 simultaneously transfers and fixes the multicolor toner image formed on the photosensitive element 1 onto a recording sheet. The control device 70 controls relevant portions of the toner image forming device 50 and the transferring/fixing device 60.

The photosensitive element 1 is, for example, charged negatively and driven to rotate by a driving mechanism (not shown) that includes a driving unit such as a motor in a clockwise direction indicated by an arrow in FIG. 1. An endless belt can be used as the image carrier instead of the photosensitive element 1.

The image forming apparatus shown in FIG. 1 forms a two-color image onto a recording medium (hereinafter, "sheet") S such as a printing material or a paper that is conveyed in a sheet conveying direction (from the left to right in FIG. 1) by a sheet feeding unit (not shown) and a registration unit (not shown). The sheet feeding unit includes a feeding roller and a pair of separating rollers and picks up the sheets S on a feeding tray (not shown) one by one to feed them in the sheet conveying direction.

The toner image forming device 50 includes first and second charging units 2-1 and 2-2, an optical scanning unit 3 that includes a writing optical system and emits laser lights 3-1 and 3-2, first and second developing units 4-1 and 4-2, and a cleaning unit 5 that removes (cleans) toner remaining on the photosensitive element 1, as an image forming unit for forming a two-color toner image of any two colors of yellow (Y), magenta (M), cyan (C) and black (K), for example, by the electrophotographic system.

In the toner image forming device 50, the first charging unit 2-1, the first developing unit 4-1, the second charging unit 2-2, and the second developing unit 4-2 are arranged around the photosensitive element 1 in this order. The first charging unit 2-1 uniformly charges the surface of the photosensitive element 1 to correspond to the first color, which is irradiated with the laser light 3-1 to form a first latent image. Then, the first latent image is developed by causing a first-color toner to adhere to the first latent image by the first developing unit 4-1 thereby forming a first-color toner image on the photosensitive element 1. Thereafter, a second-color toner image is formed on the photosensitive element 1 by the second charging unit 2-2, the optical scanning unit 3, and the second developing unit 4-2 in the same manner.

In the present embodiment, if the surface potential of the photosensitive element 1 charged by the second charging unit 2-2 is too high, a charging unit for charging the photosensitive element 1 to the opposite polarity can be provided.

The first and second charging units 2-1 and 2-2, and the first and second developing units 4-1 and 4-2 have substantially the same configuration, so that they are, in some cases, collectively denoted as a charging unit 2 and a developing unit 4, respectively, in the following explanation.

The transferring/fixing device 60 includes a transferring/fixing belt 6, a transfer bias roller 7, a heating roller 8, a pressure roller 10, and a belt cleaning unit 11. The transferring/fixing belt 6 is supported by the transfer bias roller 7 and the heating roller 8 with a predetermined tension and comes into contact with the photosensitive element 1, on which a color toner image is formed with toner T, via the transfer bias roller 7 to collectively transfer the color toner image onto the sheet S. The heating roller 8 incorporates a heater 9 for heating the sheet S and the transferring/fixing belt 6 carrying the color toner image. The pressure roller 10 comes into pressure-contact with the transferring/fixing belt 6 via the heating roller 8 to form a nip N through which the sheet S passes. The belt cleaning unit 11 removes toner or paper powder remaining on the transferring/fixing belt 6.

The operation of the image forming apparatus shown in FIG. 1 is briefly explained. The photosensitive element 1 is driven to rotate in the clockwise direction in FIG. 1 by the driving mechanism. The photosensitive element 1 is uniformly charged to, for example, a negative polarity by the first charging unit 2-1, and thereafter is irradiated with the laser light 3-1 as the first exposure corresponding to, for example, a black image. The charges on an irradiated portion of the photosensitive element 1 are attenuated to form the first latent image. The first developing unit 4-1 performs reversal development on the first latent image by using negatively-charged black toner, thereby forming a black toner image on the photosensitive element 1.

Specifically, toner is charged by triboelectric charging to be carried by a toner carrier. The toner is supplied to the developing roller. Then, the developing roller is opposed to a latent image formed on the photosensitive element 1, and the toner is adhered to the latent image on the photosensitive element 1 by the electric field formed between the photosensitive element 1 and the developing roller, thereby developing the latent image. The developing unit 4 is a two-component developing unit that forms a magnetic brush with a two-component developer containing a carrier and a toner on the developing roller and develops the latent image on the photosensitive element 1.

The potential of a portion of the photosensitive element 1 to which the toner is adhered increases after development with the black toner due to the charges of the adhered toner. However, it is not sufficient for preventing color mixture, so that the photosensitive element 1 is charged to a negative polarity again by the second charging unit 2-2.

Next, the photosensitive element 1 is irradiated with the laser light 3-2 as the second exposure corresponding to a magenta image, and charges on an irradiated portion of the photosensitive element 1 are attenuated to form the second latent image. The second developing unit 4-2 performs reversal development on the second latent image by using negatively-charged magenta toner, thereby forming a two-color image composed of the black toner image and a magenta toner image on the photosensitive element 1.

According to the present embodiment, the toner layer of the toner image on the photosensitive element 1 has a relatively small amount of toner by the action of a toner-layer filling-rate lowering unit described below. Therefore, the toner layer formed on the photosensitive element 1 has sufficient optical transparency in the following exposing process even if the toner layer is present on the photosensitive element 1, so that the toner images are superimposed on the photosensitive element 1 through the developing process to form a color toner image.

The surface of the photosensitive element 1 reaches a position opposing the transferring/fixing belt 6. The color toner image of two colors formed on the photosensitive element 1 is collectively transferred onto the transferring/fixing belt 6 at the position of the transfer bias roller 7 (transferring process).

Then, the surface of the photosensitive element 1 reaches a position opposing the cleaning unit 5, at which the toner remaining on the photosensitive element 1 is collected to clean the photosensitive element 1 (cleaning process). Thereafter, the photosensitive element 1 passes a neutralization unit (not shown) to be neutralized on its surface. A series of the image forming processes on the photosensitive element 1 is then finished.

The transferring/fixing belt 6 with the color toner image transferred on its surface is heated for a long time by the heating roller 8 while rotating in a counterclockwise direction indicated by an arrow in FIG. 1 and reaches the nip N as a pressure-contact portion formed by the heating roller 8 and the pressure roller 10. The color toner image carried by the transferring/fixing belt 6 is transferred and fixed onto the surface of the sheet S that is conveyed at a predetermined timing through a pair of registration rollers (not shown) at the nip N (transferring and fixing process).

Specifically, the transferring/fixing belt 6 is heated for a long time by the heating roller 8 until the sheet S reaches the nip N, so that the toner T of the color toner image is melted and rolled at a predetermined toner rolling rate (toner rolling process). The melted toner T is further heated and melted at the nip N because of the heat directly applied from the heating roller 8, and is fixed to the surface of the sheet S by pressure at the nip N.

According to the present embodiment, a color toner image is transferred and fixed onto a sheet through the above described transferring and fixing process, so that a small-size color image forming apparatus capable of saving energy can be provided. Moreover, a toner rolling rate adjusting unit is provided for rolling a color toner image at a predetermined toner rolling rate as described below, so that the above effects and effects and advantages to be described below can be obtained.

As described above, the image forming apparatus includes the toner-layer filling-rate lowering unit by which a toner layer can be formed on the photosensitive element 1 to have a predetermined toner-layer filling rate that is relatively low so that the toner layer has sufficient optical transparency to the laser lights 3-1 and 3-2 in the exposing process. Moreover, the image forming apparatus further includes the toner rolling rate adjusting unit. When a color toner image is transferred onto the transferring/fixing belt 6, the toner rolling rate adjusting unit rolls the color toner image at the predetermined toner rolling rate in accordance with the toner-layer filling rate that is set by the toner-layer filling-rate lowering unit.

The toner-layer filling-rate lowering unit includes first and second reflection density sensors 65-1 and 65-2 that detect density of a toner layer on the photosensitive element 1 and the control device 70 as the first control unit. The control device 70 controls a developing bias power supply circuit 67 to control a developing potential with a developing bias as at least one of the developing conditions based on signals from the reflection density sensors 65-1 and 65-2. The developing conditions include a charge potential, an exposure light quantity, and the developing bias.

The toner rolling rate adjusting unit includes the control device 70 as the second control unit that controls a heater circuit 69 to control the toner rolling rate of a color toner image with a heating temperature of the heater 9 that heats the color toner image on the transferring/fixing belt 6 as at least one of the toner layer rolling conditions. The toner layer rolling conditions include the heating temperature of the heater 9 and a pressure applied to the transferring/fixing belt 6 when the pressure roller 10 is brought into pressure-contact therewith. Therefore, the toner rolling rate adjusting unit enables the color toner image to be rolled at the predetermined toner rolling rate in accordance with the toner-layer filling rate that is set by the toner-layer filling-rate lowering unit.

The control device 70 includes therein a microcomputer in which a central processing unit (CPU) 71, a read only memory (ROM) 72, a random access memory (RAM) 73, and a timer (not shown) are connected via a signal bus (not shown). The control device 70 is provided to a control board arranging unit (not shown) in the main body of the image forming apparatus.

The CPU 71 controls the developing bias power supply circuit 67 to control a developing potential with the developing bias as the developing condition based on signals from the reflection density sensors 65-1 and 65-2 while referring to an operation program or relational data called from the ROM 72.

Moreover, the CPU 71 controls the heater circuit 69 to control the toner rolling rate of a color toner image with the heating temperature of the heater 9 as the toner-layer rolling condition so that the color toner image is rolled at the predetermined toner rolling rate in accordance with the toner-layer filling rate that is set by the toner-layer filling-rate lowering unit while referring to an operation program or relational data called from the ROM 72.

The ROM 72 stores operation programs, relational data, relational expressions, and the like that are called by the CPU 71 as needed to exert the above functions of the CPU 71. The RAM 73 includes a function of temporarily storing results of calculation by the CPU 71 and a function of storing data signals from the reflection density sensors 65-1 and 65-2 as needed.

The number of the reflection density sensors can be changed. For example, only one reflection density sensor can be provided between the first developing unit 4-1 and the second charging unit 2-2, two reflection density sensors can be arranged in an image forming unit (or an image station) capable of forming a three-color image, and two to three reflection density sensors can be arranged in an image forming unit capable of forming a four-color image as long as high accuracy is not needed for the detection of density of a toner layer on the photosensitive element 1.

A first example of the developing unit 4 is explained. As explained above with reference to FIG. 1, the toner carrier carrying at least toner charges the toner and supplies the charged toner to a conveying unit by forming an electric field with the conveying unit in non-contact state. The supplied toner is conveyed by applying voltage to multiphase electrodes (three-phase electrodes in the first example) arranged on the conveying unit. A hopping height equalizing unit is arranged in a toner conveying area with a predetermined clearance from the conveying unit. The toner is adhered to a latent image formed on the photosensitive element 1 that opposes the conveying unit to be developed, and a color image is formed on a sheet through transferring and fixing processes.

Figure 2:
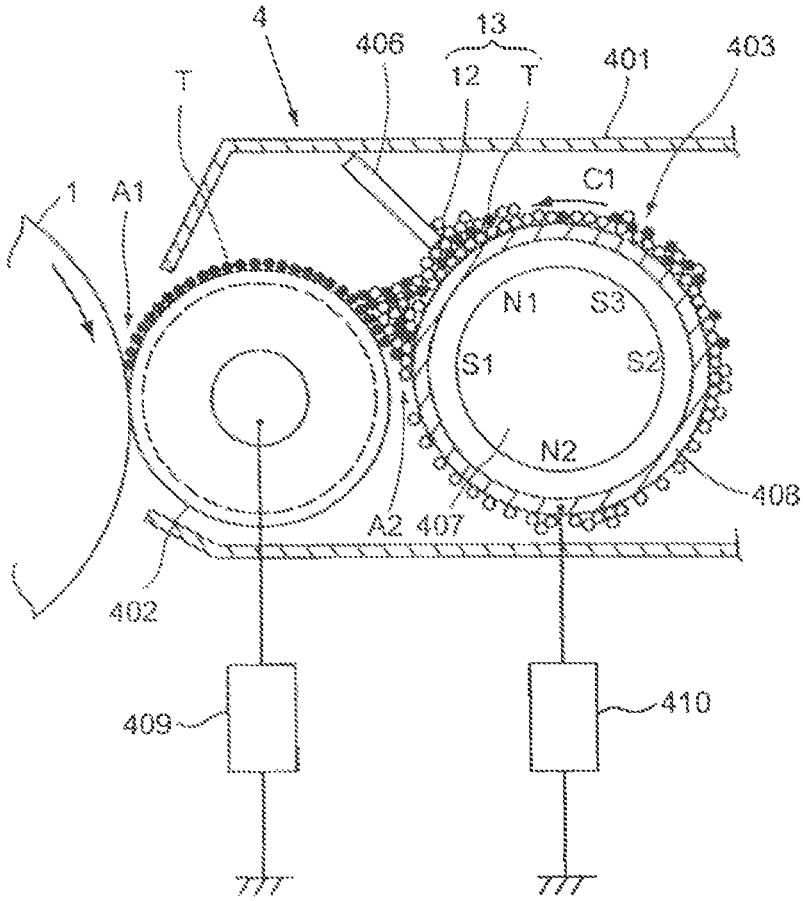
FIG. 2 is a schematic view of relevant portions of a developing unit according to a first example.

FIG. 2 is a schematic diagram of the developing unit 4 according to the first example. A developer 13 includes magnetic particles 12 denoted by hollow circles and toner T denoted by solid circles in FIG. 2. The magnetic particle 12 contains a magnetic material such as ferrite on metal or resin as a core, and a surface layer thereof is coated with a silicon resin or the like. The magnetic particle 12 preferably has a particle diameter in a range of 20 micrometers to 50 micrometers and has a dynamic resistance DR in a range of $10^4$ ohms to $10^{15}$ ohms.

Figure 3:
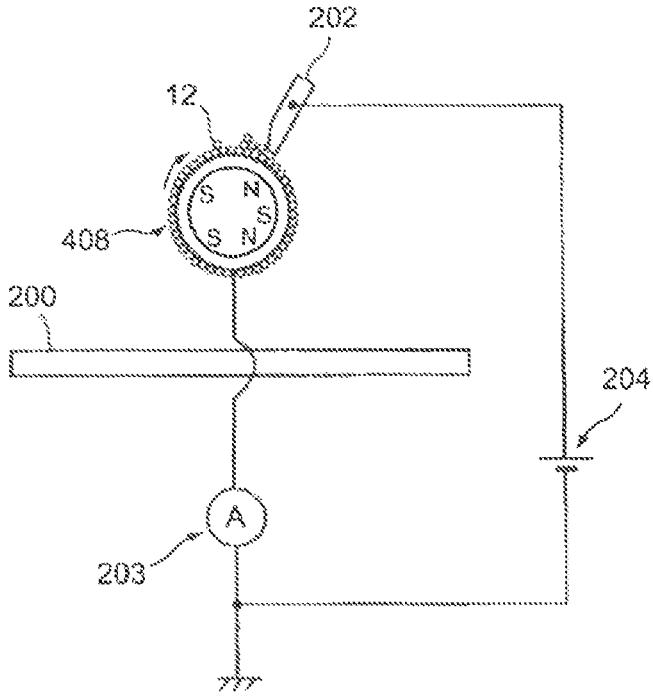
FIG. 3 is a schematic diagram of a dynamic resistance measuring device for a developer according to the first example.

The dynamic resistance DR [ohm] of the magnetic particles 12 is measured by a measuring device as shown in FIG. 3 in the following manner. First, a rotatable developing sleeve 408 as a developer carrier is set above a base 200 that is grounded. The developing sleeve 408 has a diameter of 20 millimeters and incorporates a stationary magnet at a predetermined position. A counter electrode (doctor) 202 opposes the surface of the developing sleeve 408 in an area of 65 millimeters in width and 0.5 millimeter to 1 millimeter in length with a gap of 0.9 millimeter therebetween. The developing sleeve 408 is driven to rotate at a rotating velocity of 600 revolutions per minute (628 mm/sec in linear velocity). A predetermined amount (e.g., 14 grams) of the magnetic particles 12 as a measuring target is applied to the surface of the developing sleeve 408, and the magnetic particles 12 are agitated for ten minutes by the rotation of the developing sleeve 408. Next, a current IRII [ampere] flowing between the developing sleeve 408 and the counter electrode 202 in a state where voltage is not applied to the developing sleeve 408 is measured by an ammeter 203. Next, a voltage E [volt] of a withstanding upper limit level (400 volts in a high-resistance silicon-coated carrier and a few voltages in an iron powder carrier) is applied to the developing sleeve 408 from a direct current (DC) power source 204 for 5 minutes. The voltage E is set to, although not limited, 200 volts. Then, a current IRQ (A) flowing between the developing sleeve 408 and the counter electrode 202 in a state where the voltage E is applied is measured by the ammeter 203. The dynamic resistance DR is calculated by using the following equation based on the result of the measurement.

$$DR=E/(IRQ-IRII)$$

As shown in FIG. 2, a magnetic brush roller 403 as a developing roller is composed of the rotatable non-magnetic developing sleeve 408 with a built-in magnet 407 having a plurality of magnetic poles. The magnet 407 is fixed so that the magnetic force acts on the developer 13 when the developer 13 passes predetermined positions on the developing sleeve 408. For example, the developing sleeve 408 has a diameter of 18 millimeters and is subjected to a sandblast processing to have a surface roughness Rz (average roughness of ten points) in a range of 10 micrometers to 20 micrometers.

The magnet 407 includes five magnetic poles of an N pole (N1), an S pole (S1), an N pole (N2), an S pole (S2), and an S pole (S3) in a rotating direction of the magnetic brush roller 403 from the point at which the developer 13 is regulated by a regulating blade 406. The poles of the magnet 407 can be arranged in different manner depending upon the position of the regulating blade 406 or the like.

The developer 13 is carried on the developing sleeve 408 in a brush state by the magnetic force of the magnet 407. The toner T in the magnetic brush on the magnetic brush roller 403 is mixed with the magnetic particles 12 to obtain a predetermined charge amount. The charge amount of the toner T on the magnetic brush roller 403 is preferably in the range of −10 [μC/g] to −40 [μC/g].

As shown in FIG. 2, a conveying unit 402 opposes the magnetic brush roller 403 to be in contact with the magnetic brush on the magnetic brush roller 403 in a toner supplying area A2 near the magnetic pole S1, and opposes the photosensitive element 1 in a developing area A1.

The regulating blade 406 opposes the developing sleeve 408 with a gap of, for example, 500 micrometers therebetween at the minimum, and the magnetic pole N1 is shifted a few degrees toward the upstream side in the rotating direction of the magnetic brush roller 403 with respect to the position where the regulating blade 406 oppose the magnet 407. Therefore, circulating flow of the developer 13 can be easily formed in a casing 401.

The regulating blade 406 comes in contact with the magnetic brush roller 403 to regulate the amount of the developer 13 on the magnetic brush roller 403 at a position opposing the magnetic brush roller 403, so that a predetermined amount of the developer 13 is conveyed to the toner supplying area A2 and triboelectric charging between the toner T and the magnetic particles 12 is stimulated.

The magnetic brush roller 403 is driven to rotate in a direction indicated by an arrow C1 shown in FIG. 2 by a rotary driving device (not shown), and only the toner T is supplied to the conveying unit 402 in the toner supplying area A2. The conveying unit 402 and the magnetic brush roller 403 are arranged to have a gap of, although not limited, 1.1 millimeters therebetween at the toner supplying area A2.

A plurality of voltages is applied to the electrodes of the conveying unit 402 to which a power source 409 is connected. A power source 410 is connected to the developing sleeve 408 for applying a toner supplying bias to form an electric field for toner supply in the toner supplying area A2.

The developer 13 in the casing 401 is agitated by an agitating/conveying unit (not shown), a rotation of the developing sleeve 408, and a magnetic force by the magnet 407. At this time, charges are applied to the toner T due to triboelectric charging with the magnetic particles 12.

The developer 13 carried on the magnetic brush roller 403 is regulated by the regulating blade 406, so that a predetermined amount of the developer 13 is transferred to the conveying unit 402 by the electric field formed by the toner supplying bias and the like, and the remaining is returned into the casing 401.

In the toner supplying area A2, the toner T is separated from the developer 13 carried on the magnetic brush roller 403 to transfer to the conveying unit 402. The magnetic brush roller 403 is applied with an alternating current (AC) bias voltage.

A one-component developing unit or a supplying unit for supplying a one-component developer (in which toner is triboelectrified by a developing roller and a supplying roller) can be used instead of the two-component developing unit as the developing unit 4 as long as charged toner can be supplied to the conveying unit 402.

Figure 4:
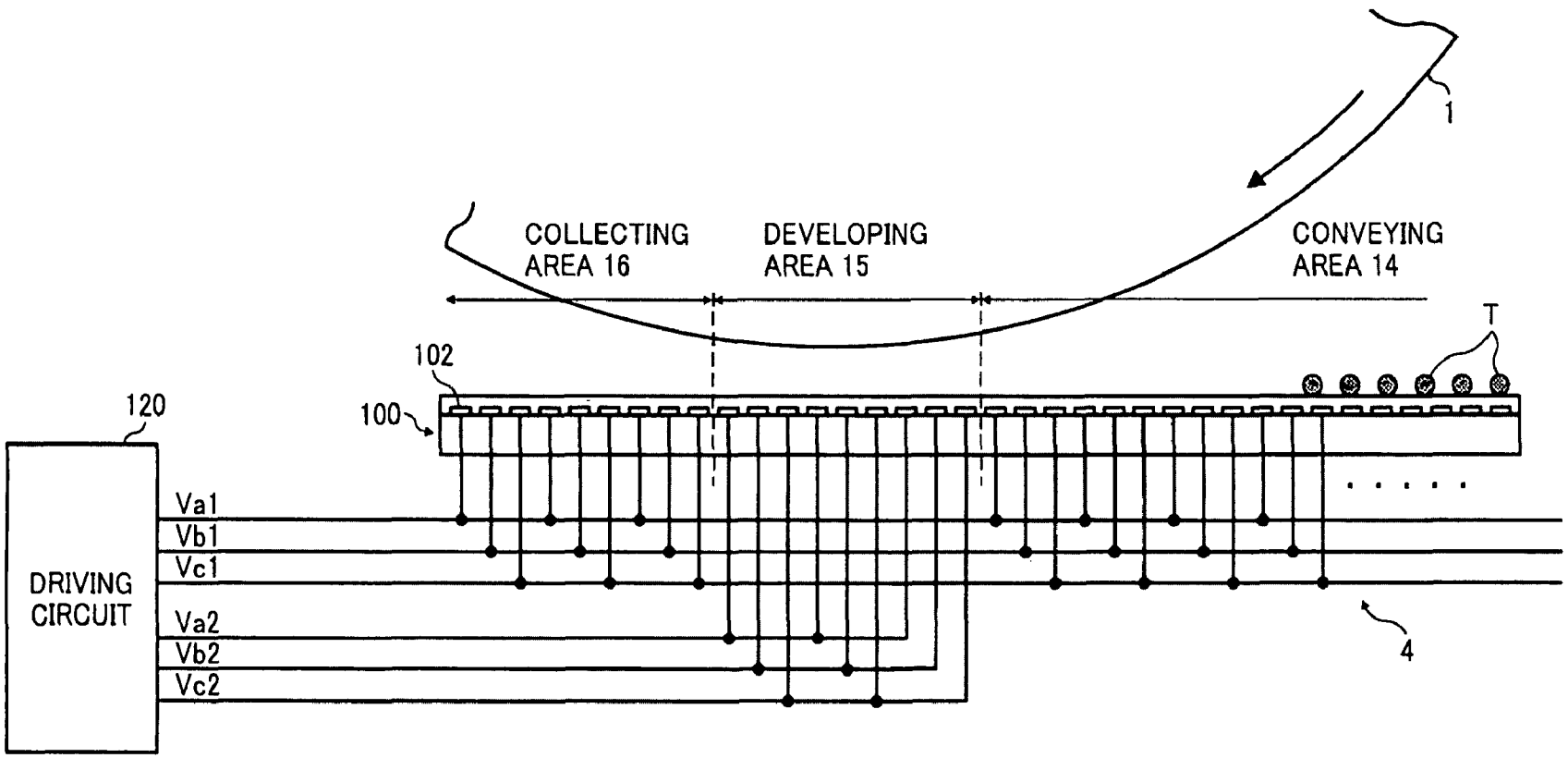
FIG. 4 is a schematic diagram of a conveying base of the developing unit.

FIG. 4 is a schematic diagram for explaining process of transferring toner from the developing unit 4 to the photosensitive element 1. The developing unit 4 includes a conveying base 100 that includes a plurality of electrodes 102 for generating an electric field for causing the toner T as powder to be conveyed, hopping, and collected. Different driving waveforms Va1 to Vc1 and Va2 to Vc2 of n-phases (three phases in the present example) for generating necessary electric fields are applied to each electrode 102 from a driving circuit 120.

The conveying base 100 is divided into a conveying area 14, a developing area 15, and a collecting area 16 based on the relationship between the range of the electrodes 102 and the photosensitive element 1. The conveying area 14 is an area in which the toner T is conveyed to a position near the photosensitive element 1, the developing area 15 is an area in which the toner T is caused to adhere to a latent image on the photosensitive element 1 to form a toner image thereon, and the collecting area 16 is the area in which the toner T is collected to the conveying base 100 side after the toner T passes the developing area 15.

In the conveying area 14, the toner T is conveyed to the position near the photosensitive element 1. In the developing area 15, an electric field is formed so that the toner T is directed to the photosensitive element 1 relative to an image area (latent image) of the photosensitive element 1 and is directed to the side opposite to the photosensitive element 1 (toward the conveying base 100 side) relative to a non-image area of the photosensitive element 1, i.e., the electric field for causing the toner T to adhere to the latent image to develop the latent image is formed. In the collecting area 16, an electric field is formed so that the toner T is directed to the side opposite to the photosensitive element 1 relative to both of the image area and the non-image area.

Therefore, the toner T is adhered to the latent image on the photosensitive element 1 to develop the latent image in the developing area 15, and the toner T that is remaining on the conveying base 100 without adhering to the photosensitive element 1 is collected to the conveying base 100 side in the collecting area 16 on the downstream side in the rotating direction (moving direction) of the photosensitive element 1, so that the toner T is surely prevented from scattering.

Figure 5:
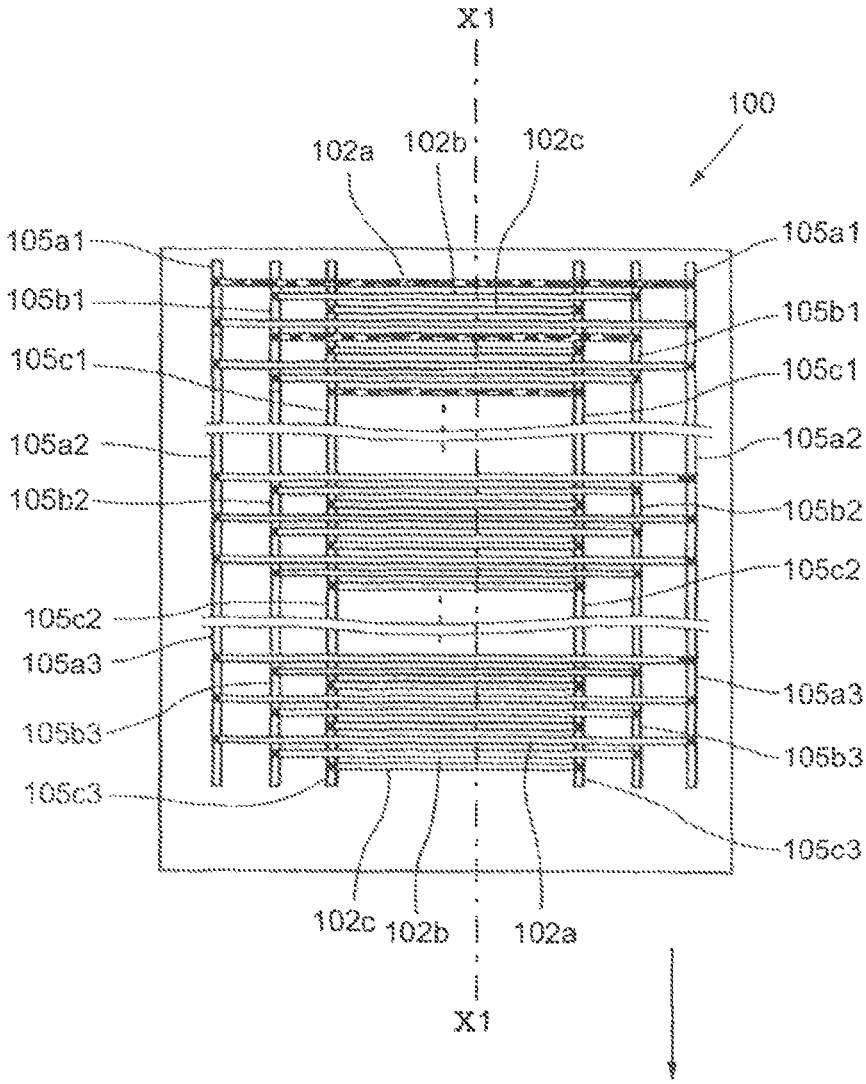
FIG. 5 is a plan view of the conveying base.
Figure 6:
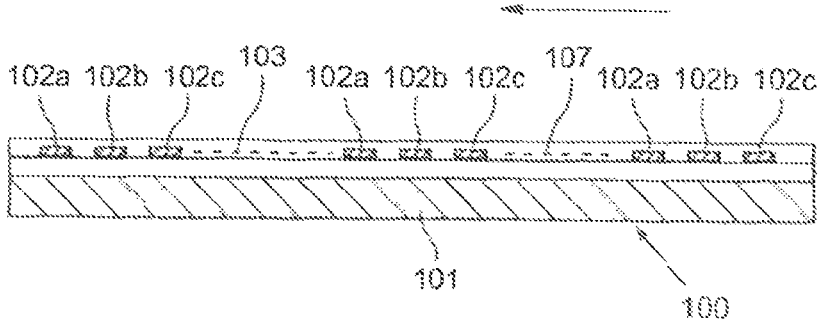
FIG. 6 is a cross-sectional view of the conveying base taken along line X1-X1 in FIG. 5.

FIG. 5 is a plan view of the conveying base 100, and FIG. 6 is a cross-sectional view of the conveying base 100 taken along line X1-X1 in FIG. 5.

In the conveying base 100, a plurality of sets of electrodes 102*a*, 102*b*, and 102*c* (hereinafter, collectively called "electrodes 102" in some cases) each of which extends in a direction approximately perpendicular to a toner conveying direction as indicated by an arrow in FIGS. 5 and 6 is arranged on a support substrate 101 in the toner conveying direction with a predetermined interval therebetween, and a surface protecting layer 103 made of inorganic or organic insulating material is laminated to cover the surface of the electrodes 102 as a protection film. The surface protecting layer 103 is a conveying surface on which the toner is conveyed to serve as a conveying surface forming member. The surface protecting layer 103 can be covered with a surface layer having higher compatibility with powder (toner).

Common electrodes 105*a*1, 105*a*2, 105*a*3, 105*b*1, 105*b*2, 105*b*3, 105*c*1, 105*c*2, and 105*c*2 (hereinafter, collectively called "common electrodes" in some cases) are provided on both ends of the electrodes 102*a*, 102*b*, and 102*c*, respectively, to interconnect each of the electrodes 102*a*, 102*b*, and 102*c* at both ends thereof. The common electrodes extend in the toner conveying direction, i.e., a direction approximately perpendicular to the direction in which the electrodes 102*a*-102*c* extend. The width (in the direction perpendicular to the tone conveying direction) of the common electrodes are set larger than the width (in the tone conveying direction) of electrodes 102*a*-102*c*. In FIG. 5, the common electrodes are denoted as the common electrodes 105*a*1, 105*b*1, and 105*c*1 in the conveying area 14, as the common electrodes 105*a*2, 105*b*2, and 105*c*2 in the developing area 15, and as the common electrodes 105*a*3, 105*b*3, and 105*c*3 in the collecting area 16.

An interlayer dielectric film 107 is formed after the patterns of the common electrodes 105*a*, 105*b*, and 105*c* are formed on the support substrate 101. The interlayer dielectric film 107 can be made of any material. Then, contact holes (not shown) are formed in the interlayer dielectric film 107, and thereafter the electrodes 102*a*, 102*b*, and 102*c* are formed to be interconnected to the common electrodes 105*a*, 105*b*, and 105*c*, respectively, through the contact holes.

Alternatively, the electrode can have a three-layer structure. Specifically, the interlayer dielectric film 107 is formed on a pattern of the electrodes 102*a* and the common electrodes 105*a* that are formed uniformly, on which a pattern of the electrodes 102*b* and the common electrodes 105*b* that are uniformly formed is formed. Then, the interlayer dielectric film 107 is formed thereon again, on which a pattern of the electrode 102*c* and the common electrode 105*c* that are uniformly formed is further formed. Still alternatively, the electrode can be formed so that the electrodes 102 and the common electrodes 105 are interconnected by using both methods of uniformly forming patterns of the electrodes 102 and the common electrodes 105 and forming the contact holes.

Input terminals (not shown) for inputting driving signals (driving waveforms) Va, Vb, and Vc from the driving circuit 120 are provided to the common electrodes 105. The input terminals can be provided on the back side of the support substrate 101 and be connected to the common electrodes 105 via through holes or provided on the interlayer dielectric film 107.

The support substrate 101 can be made of an insulating material such as glass, resin, and ceramic, or can be formed by depositing an insulating film made of $SiO_2$ or the like on a substrate made of a conductive material such as a stainless used steel (SUS). Alternatively, the support substrate 101 can be made of a deformable material such as a polyimide film.

The electrode 102 is formed by depositing a conductive material such as Al and Ni—Cr with a thickness of 0.1 micrometers to 10 micrometers, preferably 0.5 micrometers to 2.0 micrometers, on the support substrate 101 and forming a required electrode pattern by the photolithographic technique or the like. The length of the electrode 102 in the toner conveying direction is in the range of one to twenty times of an average particle diameter of toner particles to be conveyed, and the interval between the electrodes 102 in the toner conveying direction is in the range of one to twenty times of an average particle diameter of toner particles to be conveyed.

The surface protecting layer 103 is formed by depositing a material such as $SiO_2$, $TiO_2$, $TiO_4$, SiON, BN, TiN, and $Ta_2O_5$ with a thickness of 0.5 micrometers to 10 micrometers, preferably 0.5 micrometers to 3 micrometers. Alternatively, an inorganic nitride compound such as SiN, BN, and W can be used as the material of the surface protecting layer 103. Particularly, because the charge amount of the charged toner tends to decrease while being conveyed as surface hydroxyl (SiOH, silanol group) increases, the inorganic nitride compound containing less surface hydroxyl is preferably used.

A principle of electrostatic conveying of toner on the conveying base 100 constructed in such a manner is explained. When n-phase driving waveforms are applied to the electrodes 102, a phase-shift electric field (progressive-wave electric field) is generated by the electrodes 102 and the toner charged on the conveying base 100 receives repulsive force and/or attractive force, so that the toner moves in the toner conveying direction while hopping and being conveyed.

Figure 7:
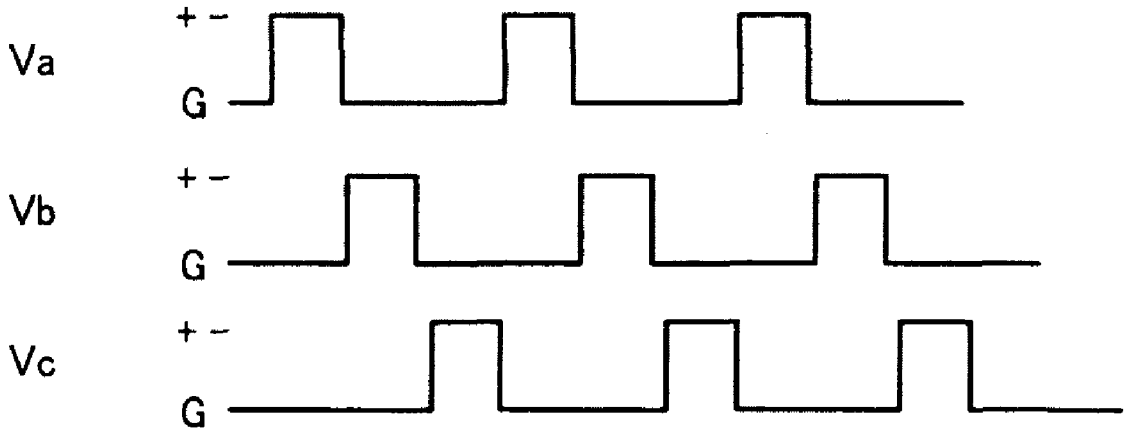
FIG. 7 is a schematic diagram of driving waveforms applied to the conveying base as one example.

For example, as shown in FIG. 7, three-phase pulse-like driving waveforms (driving signals) A (phase A), B (phase B), and C (phase C) changing between a ground potential "G" (zero volt) and a positive voltage "+" are applied to the electrodes 102 at different times.

Figure 8:
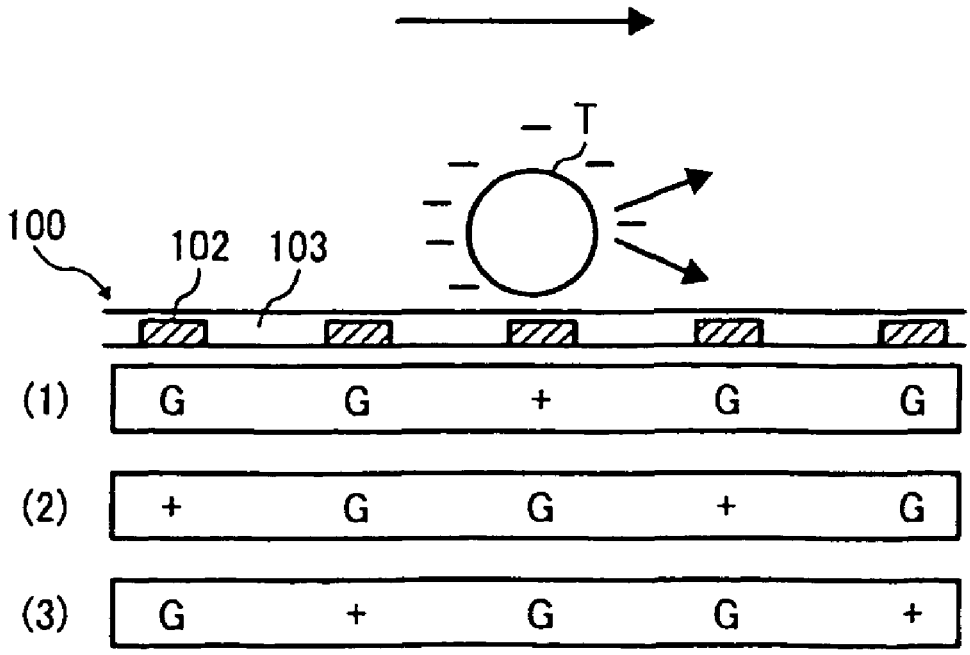
FIG. 8 is a schematic diagram for explaining toner conveying and hopping.

At this time, as shown in FIG. 8, while negatively charged toner T is on the conveying base 100, when "G", "G", "+", "G", and "G" as shown in (1) of FIG. 8 are applied to the electrodes 102 successively arranged in the conveying base 100, the negatively charged toner T is positioned above the electrode 102 to which the positive voltage "+" is applied.

At the next timing, "+", "G", "G", "+", and "G" are applied to the electrodes 102 as shown in (2) of FIG. 8. The negatively charged toner T receives repulsive force from the left electrode 102 having the ground potential "G" and attractive force from the right electrode 102 having the positive voltage "+", so that the negatively charged toner T moves to the side of the right electrode 102 having the positive voltage "+". Furthermore, at the following timing, "G", "+", "G", "G", and "+" is applied to the electrodes 102 as shown in (3) of FIG. 8. The negatively charged toner T receives repulsive force and attractive force in the same manner, so that the negatively charged toner T further moves to the side of the right electrode 102 having the positive voltage "+".

The progressive-wave electric field is generated on the conveying base 100 by applying multi-phase driving waveforms with changing voltage to the electrodes 102, so that the negatively charged toner T moves in a direction in which the progressive-wave electric field moves while hopping and being conveyed. When the toner T is positively charged, the positively charged toner moves in the same direction in the same manner by inverting the above-mentioned driving waveform changing pattern.

Figure 9A:
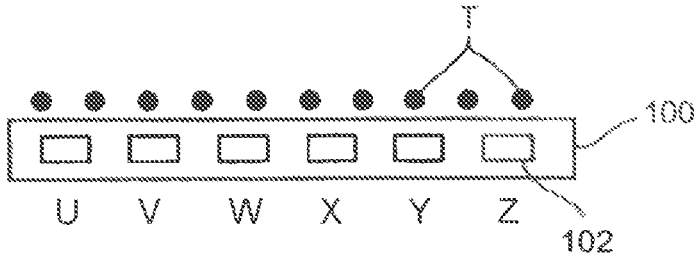
FIGS. 9A to 9D are schematic diagrams for explaining a specific example of the toner conveying and hopping.
Figure 9B:
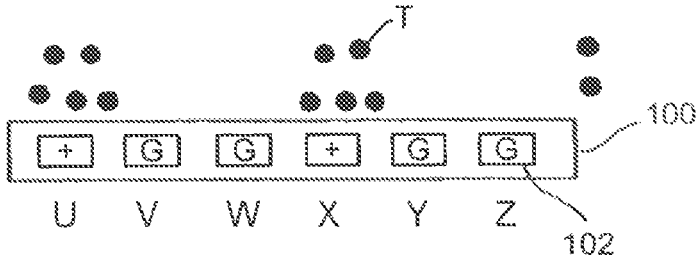
Figure 9C:
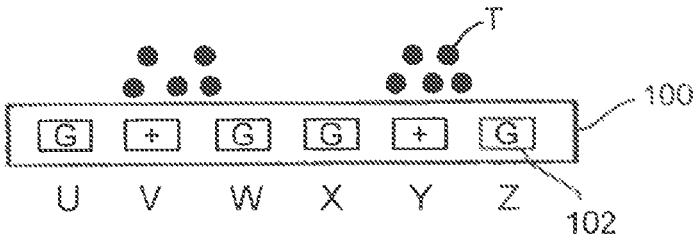
Figure 9D:
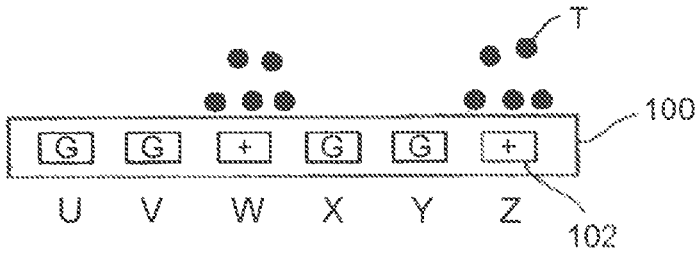

The movement of the toner T on the conveying base 100 explained above by referring to FIG. 8 is explained more specifically with reference to FIGS. 9A to 9D. As shown in FIG. 9A, while the negatively charged toner T is on the conveying base 100 and the electrodes U to Z of the conveying base 100 have zero volt (G), when the positive voltage "+" is applied to the electrodes U and X as shown in FIG. 9B, the negatively charged toner T is attracted to the electrodes U and X and moves onto the electrodes U and X. At the next timing, as shown in FIG. 9C, when the electrodes U and X both have the ground potential "G" and the positive voltage "+" is applied to the electrodes V and Y, the toner T on the electrodes U and X receives repulsive force from the electrodes U and X and attractive force from the electrodes V and Y, so that the toner T is conveyed to the electrodes V and Y. Furthermore, at the next timing, as shown in FIG. 9D, when the electrodes V and Y both have the ground potential "G" and the positive voltage "+" is applied to the electrodes W and Z, the toner T on the electrodes V and Y receives repulsive force from the electrodes V and Y and attractive force from the electrodes W and Z, so that the toner T is conveyed to the electrodes W and Z. In this manner, the toner T is successively conveyed in the right direction in FIGS. 9A to 9D in accordance with the progressive-wave electric field.

Figure 10:
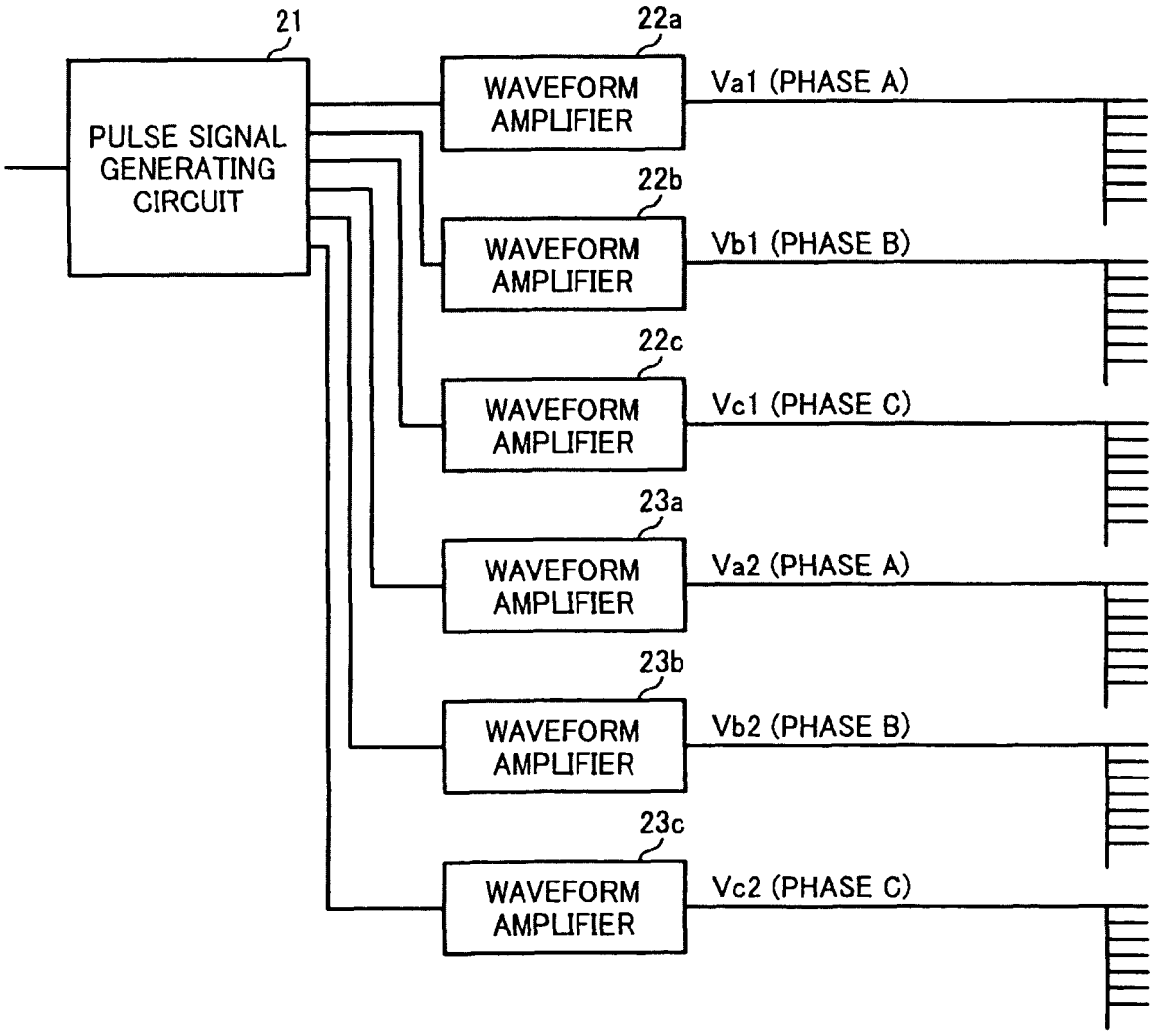
FIG. 10 is a block diagram of a driving circuit shown in FIG. 4 as one example.

The entire structure of the driving circuit 120 is explained with reference to FIG. 10. The driving circuit 120 includes a pulse signal generating circuit 21 for generating and outputting pulse signals, waveform amplifiers 22*a*, 22*b*, and 22*c* for receiving the pulse signals from the pulse signal generating circuit 21 and generating and outputting driving waveforms Va1, Vb1, and Vc1, and waveform amplifiers 23*a*, 23*b*, and 23*c* for receiving the pulse signals from the pulse signal generating circuit 21 and generating and outputting driving waveforms Va2, Vb2, and Vc2.

The pulse signal generating circuit 21 receives, for example, a logic level input pulse, and generates and outputs pulse signals of two groups of pulses each being phase-shifted by 120° having an output voltage of 10 volts to 15 volts capable of performing 100 V switching by driving a switching unit (not shown) such as a transistor included in the waveform amplifiers 22*a* to 22*c* and 23*a* to 23*c*.

Figure 11:
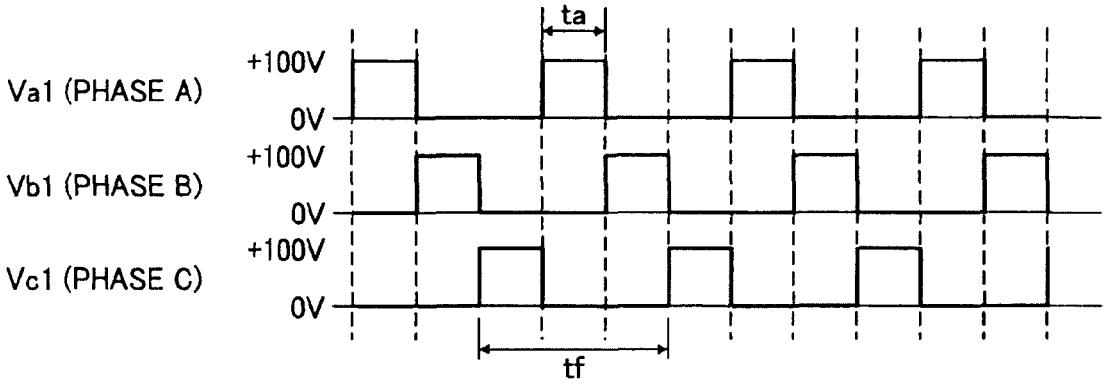
FIG. 11 is a schematic diagram of driving waveforms of a conveying voltage pattern or a collection conveying voltage pattern as one example.

The waveform amplifiers 22*a*, 22*b*, and 22*c* apply to each of the electrodes 102 in the conveying area 14 and the collecting area 16 shown in FIG. 4 three-phase driving waveforms (driving pulses) Va1, Vb1, and Vc1 in which an application time ta of +100 volts for each phase is set to be about 33% (⅓) of a repetition cycle tf (hereafter, "conveying voltage pattern" or "collection conveying voltage pattern") as shown in FIG. 11, for example.

Figure 12:
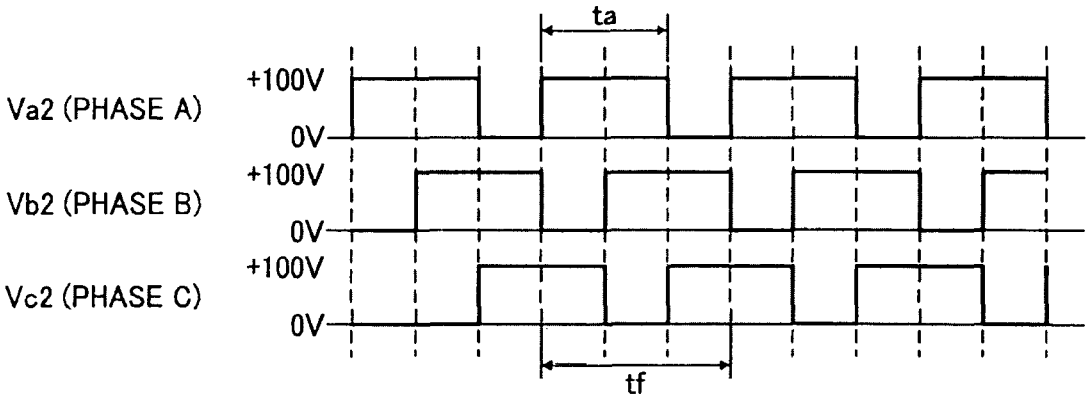
FIG. 12 is a schematic diagram of driving waveforms of a hopping voltage pattern as one example.
Figure 13:
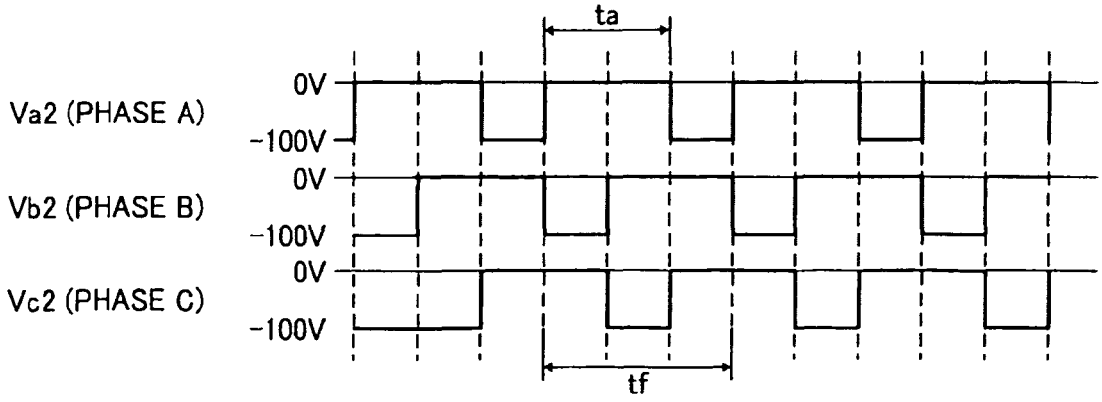
FIG. 13 is a schematic diagram of driving waveforms of a hopping voltage pattern as another example.

The waveform amplifiers 23*a*, 23*b*, and 23*c* apply to each of the electrodes 102 in the developing area 15 of FIG. 4 three-phase driving waveforms (driving pulses) Va2, Vb2, and Vc2 in which the application time ta of +100 volts or 0 volt for each phase is set to be about 67% (⅔) of the repetition cycle tf (hereafter, "hopping voltage pattern") as shown in FIGS. 12 and 13, for example.

As explained above, in the electrostatic hopping phenomenon (EH phenomenon), the toner is caused to be hopping, so that it is possible to perform reversal development of an electrostatic latent image on the photosensitive element 1 using a one-component developer. In other words, a device for forming an electric field in the developing area 15 is provided so that the toner is directed to the latent image carrier relative to the image area of the latent image carrier and is directed to the side opposite to the latent image carrier relative to a non-image area of the latent image carrier, thereby developing the latent image.

For example, in the pulse-like voltage waveforms changing from 0 volt to +100 volts such as the driving waveforms of the conveying voltage pattern or the collection conveying voltage pattern as shown in FIG. 11, when the electric potential of the non-image area is lower than −100 volts, the toner is directed to the latent image carrier relative to the image area and is directed to the side opposite to the latent image carrier relative to the non-image area. It was confirmed that the toner is directed to the latent image carrier when the electric potential of the non-image area is −150 volts or −170 volts.

When the driving waveforms of the conveying voltage pattern or the collection conveying voltage pattern are pulse-like voltage waveforms changing from 20 volts to −80 volts, and the electric potential of the image area is about 0 volt and the electric potential of the non-image area is −110 volts, the lowest electric potential of the pulse-like driving waveforms is between the electric potentials of the image area and the non-image area, so that the toner is directed to the latent image carrier relative to the image area and is directed to the side opposite to the latent image carrier relative to the non-image area in the same manner.

In other words, it is possible to prevent the toner from adhering to the non-image area by setting the lowest electric potential of the pulse-like driving waveforms between the electric potentials of the image area and the non-image area, enabling to perform high-quality development.

In this manner, in the EH phenomenon, the toner is attracted and adheres to the image area because of the hopping of the toner, and the toner is repelled and does not adhere to the non-image area, so that the latent image is developed with the toner. In this case, because almost no attractive force is generated to the hopping toner from the conveying base, it is possible to readily transfer the hopping toner to the latent image carrier, enabling to perform high-quality development in a low voltage.

In a conventional jumping development, applied voltage exceeding adhesion force of the toner to the developing roller is necessary to separate the charged toner from the developing roller and transfer the toner to the photosensitive element, so that a bias voltage of direct current (DC) 600 volts to 900 volts is needed. By contrast, in the present example, although the adhesion force of the toner usually ranges from 50 nanoNewtons to 200 nanoNewtons, the adhesion force to the toner hopping on the conveying base 100 becomes substantially zero. Therefore, the force for separating the toner from the conveying base 100 is not needed. Thus, it is possible to sufficiently transfer the toner to the latent image carrier in a low voltage.

Furthermore, even when voltage to be applied between the electrodes 102 is a low voltage not more than 150 volts to 100 volts, an electric field to be generated has extremely large value, so that the toner adhered to the surface of the electrodes 102 can be readily separated therefrom to cause the toner to be flying or hopping. In addition, it is possible to substantially reduce or eliminate an amount of ozone or NOx generated when an organic photoconductor (OPC) or the like is used and charged, which is extremely advantageous in terms of environmental issues and durability of the photosensitive element.

Therefore, it is not necessary to have a high voltage bias of 500 volts to several kilovolts applied between the developing roller and the photosensitive element for separating the toner adhered to the surface of the developing roller or the carrier as in the conventional method, so that the latent image can be formed and developed with the electric potential of the photosensitive element set at a very low voltage.

For example, when the organic photoconductor, on the surface of which a charge transport layer (CTL) having a thickness of 15 micrometers and relative permittivity $\in$ of 3 is formed, is used, and charge density of the charged toner is $-3\times-10^4$ [C/m$^2$], a surface potential of the organic photoconductor is about −170 volts. In this case, when pulse-like driving voltages of 0 volt to −100 volts are applied as applied voltages to the electrodes of the conveying base with a duty cycle of 50%, an average of the applied voltages is −50 volts. Therefore, when the toner is negatively charged, an electric field between the electrodes of the conveying base and the organic photoconductor has the relationship as described above.

In this case, when a gap (space) between the conveying base and the organic photoconductor is from 0.2 millimeters to 0.3 millimeters, development is sufficiently performed. Although development depends on coulomb/mass (Q/M) of the toner, voltage applied to the electrodes of the conveying base, and printing speed, i.e., rotation velocity of the photosensitive element, development is sufficiently performed with negatively charged toner when an electric potential for charging the photosensitive element is at least not more than −300 volts or −100 volts when development efficiency has priority. When the toner is positively charged, the electric potential of the charged toner has positive potential.

The EH phenomenon utilizes hopping of the toner on the conveying base 100 to perform development by causing the adhesion force between the conveying base 100 and the toner to be zero. However, it was confirmed that even when the hopping toner has progressive properties towards the latent image carrier, the toner does not reliably adhere to the latent image of the latent image carrier in some cases by merely causing the toner to be hopping on the conveying base 100, which may cause toner scattering.

In view of this, the inventors have found the condition as described above in regard to the EH phenomenon, in which the hopping toner reliably adheres to the image area in a selective manner without adhering to the non-image area, namely, without causing scumming.

Specifically, a relationship between the electric potential (surface potential) of the latent image and the electric potential (electric field to be generated) to be applied to the conveying base is set to a predetermined relationship so that the electric field is generated in which the toner is directed to the latent image carrier relative to the image area and is directed to the conveying base side relative to the non-image area as described above. In accordance with this, the toner is reliably adhered to the image area and the toner directed to the non-image area is repelled to the conveying base side. Thus, the toner hopping on the conveying base is efficiently used for development, which results in preventing scattering of the toner, thus enabling to perform high-quality development through low-voltage driving.

In this case, an average potential of electric potentials applied to the electrodes of the conveying base is set to a value between the electric potentials of the image area and the non-image area, so that it is possible to generate the electric field in which the toner is directed to the latent image carrier relative to the image area and is directed to the conveying base relative to the non-image area as described above. At this time, the toner is hopping and the development threshold voltage is lowered, so that the toner is apart from the electrodes (cloud development). Therefore, a latent image can uniformly be developed even if the amount of toner adhering to the latent image is small.

Figure 14:
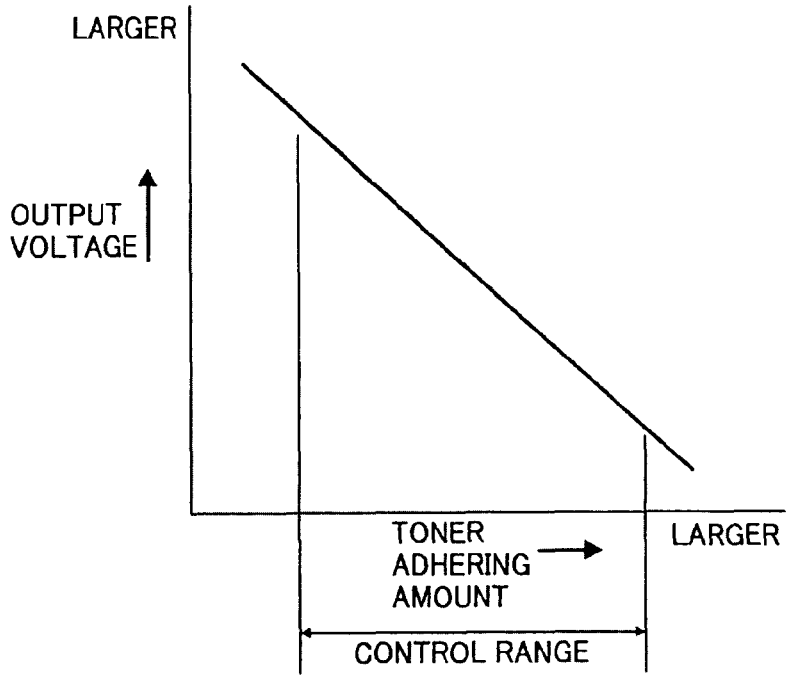
FIG. 14 is a graph representing a relationship between voltage output from a reflection density sensor and a toner adhering amount.

As shown in FIG. 1, the reflection density sensors 65-1 and 65-2 detect reflection density ID of the toner that is regarded as the amount of toner adhering to the photosensitive element 1 (hereinafter, "toner adhering amount" in some cases) because the reflection density ID is proportional to the toner adhering amount. The data on the toner adhering amount is obtained by utilizing the toner layer adhering condition as shown in FIG. 14, i.e., the inverse relationship between the toner adhering amount and the voltage output from the reflection density sensors 65-1 and 65-2 in accordance with the toner adhering amount. Each of the reflection density sensors 65-1 and 65-2 is composed of a light-reflection type optical sensor with a built-in light source, and an "EE-SY100" (reflective photosensor) manufactured by Omron Corporation is used as the reflection density sensors 65-1 and 65-2 for obtaining the following data.

Figure 15:
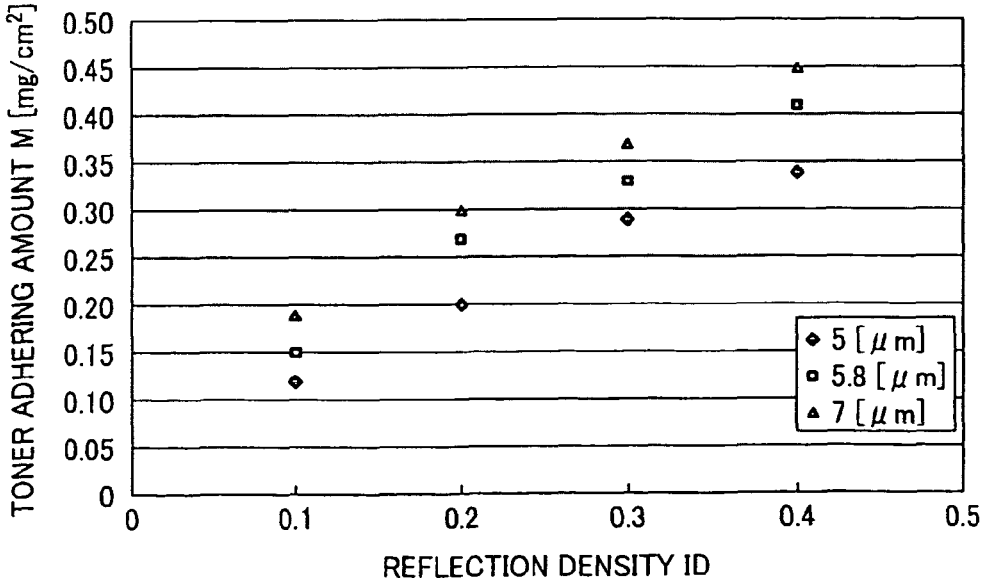
FIG. 15 is a graph representing a relationship between a reflection density and the toner adhering amount.

As a result of precise measurements and experiments on the relationship between a toner adhering amount M on the photosensitive element 1 and the reflection density ID (density of an unfixed image on the photosensitive element 1) by changing the toner adhering amount M for three different toner particle diameters (5.0, 5.8, and 7.0 micrometers in volume average particle diameter), it was found that the relationship changes depending upon the toner particle diameter as shown in FIG. 15. The data on the toner adhering amount M is obtained from the reflection density ID utilizing the relationship shown in FIG. 15. The toner adhering amount M is controlled not to exceed the solid toner adhering amount (maximum toner adhering amount) of 0.3 [mg/cm$^2$].

Figure 16:
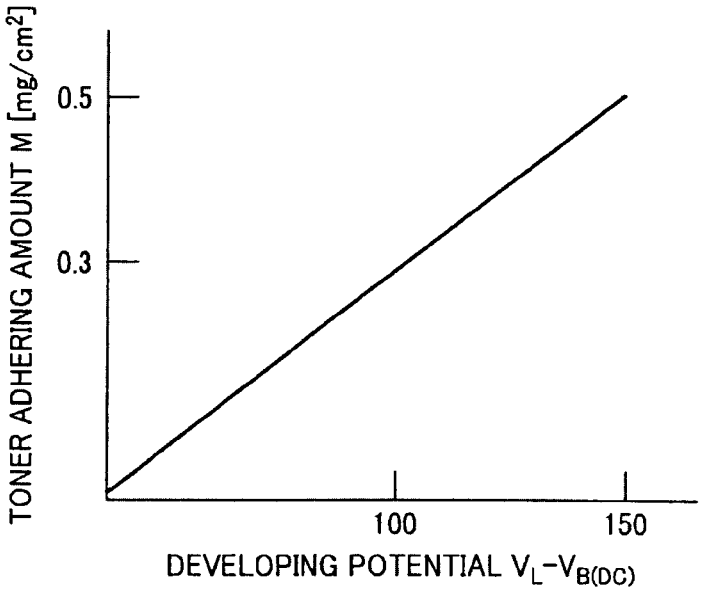
FIG. 16 is a graph representing a relationship between a developing potential and the toner adhering amount.

As described above, the developing conditions as control targets include the charge potential, the exposure light quantity, and the developing bias, at least one of which is used to change the developing potential. FIG. 16 is a graph representing a relationship between the developing potential and the toner adhering amount M. The developing potential is calculated by subtracting a developing bias $V_{B\ (DC)}$ from a post-exposure potential $V_L$.

With regard to the relationship with the toner-layer filling rate, data on the toner layer height and the toner adhering amount is needed. The toner-layer filling rate can be calculated by determining the diameter and shape of the toner particles.

The toner-layer filling rate is evaluated by measuring the toner adhering condition a plurality of times. Both of the data on the toner layer height and the toner adhering amount are related to the mass of the toner, however, one of them is a value that depends upon the value obtained by multiplying the toner layer height by a toner layer target area for development. The toner layer height is obtained by measuring the toner layer height distribution by using an optical microscope (not shown) or a laser microscope manufactured by Keyence Corporation and calculating the average height. When a mass M1 is calculated by multiplying the specific gravity of the toner, which is known, the target area, and the average height, and a mass M2 is calculated by multiplying the target area by the toner adhering amount based on the toner adhering amount data, the toner-layer filling rate is obtained by dividing the mass M2 by the mass M1 and then multiplying by 100%.

Figure 17:
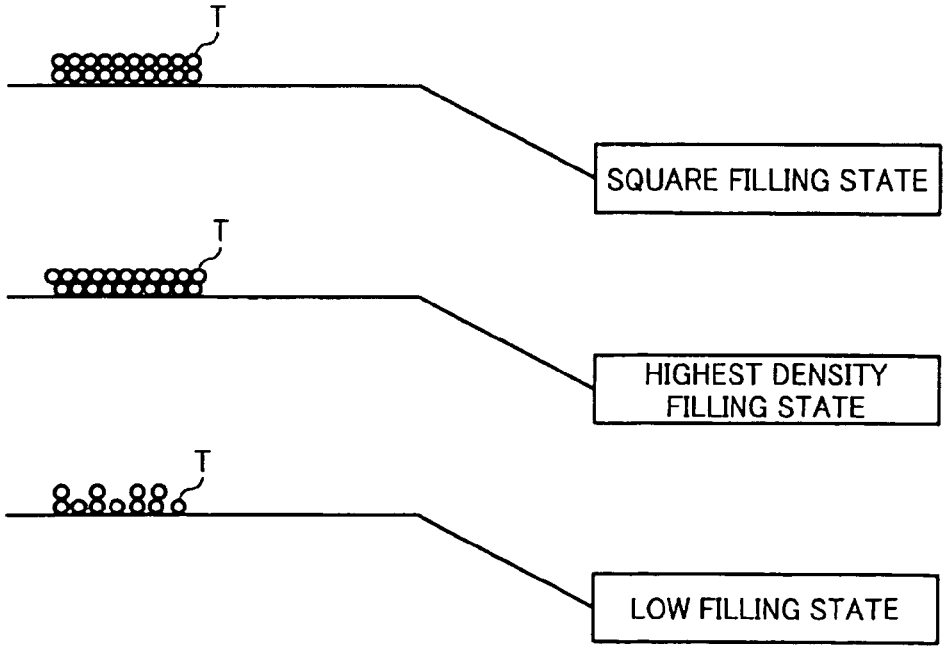
FIG. 17 is a schematic diagram for explaining a toner-layer filling state.

As shown in FIG. 17, the toner-layer filling rate can roughly be classified into three types of (1) a square filling state, (2) a highest density filling state, and (3) a low filling state. In the square filling state, the minimum optical transparency for development is ensured, and the toner is charged too much when the photosensitive element is recharged. In the highest density filling state, the optical transparency sufficient for development cannot be ensured, and the toner is charged too much when the photosensitive element is recharged. In the low filling state, the optical transparency sufficient for development can be ensured and the toner charging can be reduced when the photosensitive element is recharged, however, a uniform image cannot be obtained in a typical fixing. In the present example, toner images are formed on the photosensitive element 1 in the low filling state. The toner-layer filling rate in the low filling state is in the range of 30% to 40%, which may result in a low-quality image due to the low toner density as an image or nonuniform toner density in an image in the typical fixing. However, in the present example, the toner image is rolled at a high toner rolling rate in the transferring and fixing process to form a uniform image.

The charge amount of the toner is set relatively high to increase the distance between toner particles. The charge amount of the toner is generally increased for reducing the developing toner amount based on the concept that development continues until a charge amount corresponding to the developing potential determined by subtracting the DC developing bias from the post-exposure potential is charged in the reversal development, so that the amount of the toner finally adhering to the latent image is reduced when the charge amount of the toner is large. However, the present example further utilizes repulsive force between toner particles to cause the distance between the toner particles to be large. Moreover, the distance between the toner particles is increased by changing a toner shape from a perfect sphere into an irregular shape, increasing a particle diameter to increase a space between the toner particles, or changing a toner surface state by causing an additive of sub-micron order such as silica oxide and titanium oxide to be adhered to the toner particles.

Figure 18:
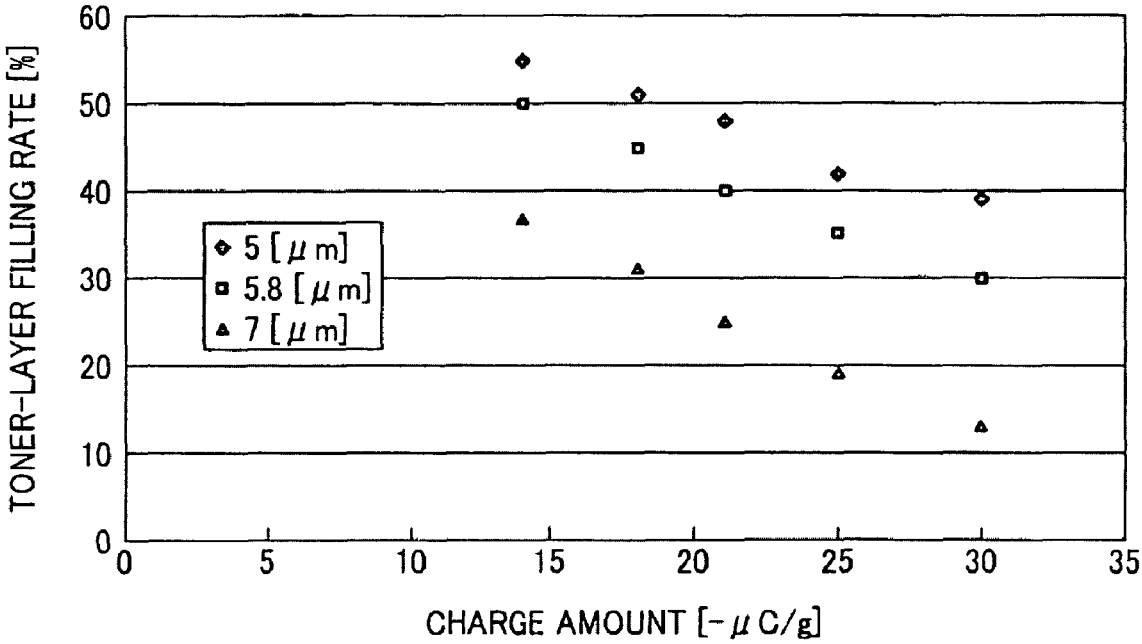
FIG. 18 is a graph representing a relationship between a toner charge amount and the toner-layer filling rate.

FIG. 18 is a graph representing a relationship between the toner charge amount and the toner-layer filling rate, and the distance between the toner particles can be controlled based on a charge amount, a shape, and a diameter of toner, and additive. As shown in FIG. 18, it is found that the relationship between the toner charge amount and the toner-layer filling rate changes depending upon the toner particle diameter.

Figure 19:
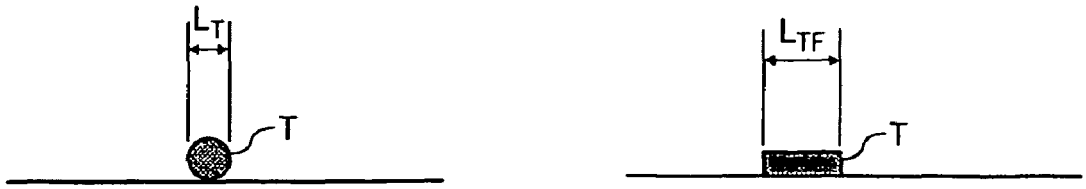
FIG. 19 is a schematic diagram for explaining a toner rolling rate.

FIG. 19 is a schematic diagram for explaining the definition of the toner rolling rate. A toner rolling rate $R_{RL}$ is calculated by the following equation:

$$R_{RL}=S_{FIX}/S_{DEV}$$

where $S_{FIX}$ is an area of the toner layer after fixing, and $S_{DEV}$ is an area of the toner layer when adhered to the photosensitive element (before fixing). Moreover, the toner rolling rate $R_{RL}$ satisfies the following equation:

$$(R_{RL})^2=a\times(L_{TF}/L_T)^2$$

where "a" is a constant number, and $L_T$ and $L_{TF}$ are widths of the toner layer before and after fixing, respectively.

As the toner-layer filling-rate lowering unit for lowering the toner-layer filling rate, the reflection density sensors 65-1 and 65-2 are arranged at predetermined positions opposing the photosensitive element 1 as shown in FIG. 1 and the control device 70 controls the developing toner adhering amount by appropriately adjusting the developing bias. Specifically, the CPU 71 of the control device 70 controls the developing bias power supply circuit 67 to control the developing potential with the developing bias as the developing condition based on signals from the reflection density sensors 65-1 and 65-2 while referring to an operation program or relational data (data table generated based on data represented in FIGS. 15 and 18) called from the ROM 72.

As shown in FIG. 1, the color toner image formed on the photosensitive element 1 is transferred onto the transferring/fixing belt 6, on which the color toner image is heated and melted to be transferred or simultaneously transferred and fixed onto the sheet S. The toner on the transferring/fixing belt 6 is heated to be melted, and the melted toner is uniformly rolled while being transferred and fixed on the sheet S. Therefore, fixing property of the toner to the sheet is improved. In this case, however, the photosensitive element 1 may be heated, so that a cooling roller is provided to lower the temperature of the photosensitive element 1.

As shown in FIG. 1, the CPU 71 controls the heater circuit 69 to control the toner rolling rate of a color toner image with the heating temperature of the heater 9 as the toner-layer rolling condition so that the color toner image is rolled at the predetermined toner rolling rate in accordance with the toner-layer filling rate that is set by the toner-layer filling-rate lowering unit while referring to an operation program or relational data called from the ROM 72.

The cooling roller preferably has a configuration in which water running inside as a cooling medium is cooled to near the room temperature by a radiator provided outside. Alternatively, the cooling roller can be configured such that a heat pipe is provided inside and fins for increasing a heat radiating area are provided at the end portion of the heat pipe.

No dew condensation occurs in the above both cases because the temperature of the cooling roller does not become below the room temperature. However, the cooling roller can be cooled by cooling wind or a cooling medium using a peltier element or the like to obtain instantaneous cooling effect on the surface of the cooling roller. In this case, to prevent dew condensation, the air near the surface of the cooling roller needs to be dehydrated in advance by lowering the temperature once by utilizing the above cooling element or using absorbent such as silica gel.

Figure 28:
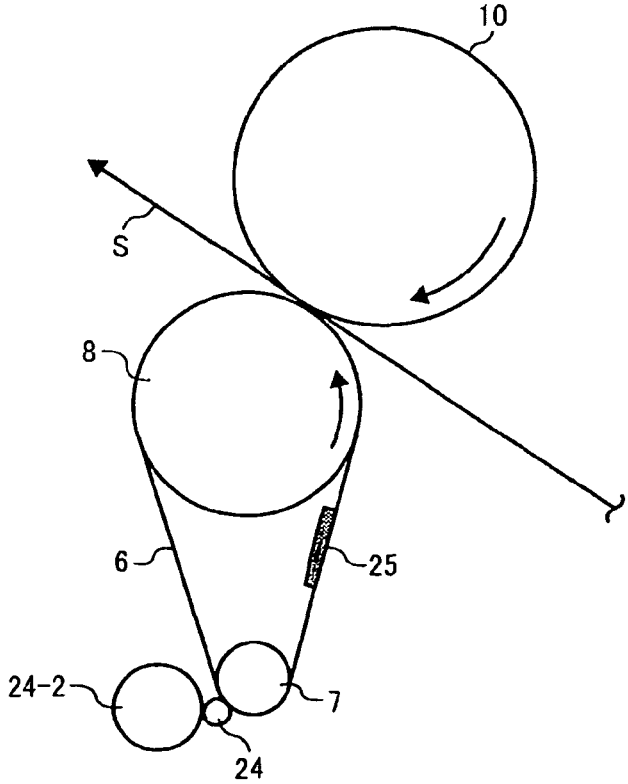
FIG. 28 is a schematic diagram of a transferring/fixing unit and its periphery as one example.

As shown in FIG. 28, a cooling roller 24 is provided near the transferring unit, and a cooling roller 24-2 is provided to be in contact with the cooling roller 24. The cooling roller 24-2 has a diameter larger than that of the cooling roller 24 to radiate a large amount of heat.

Figure 29:
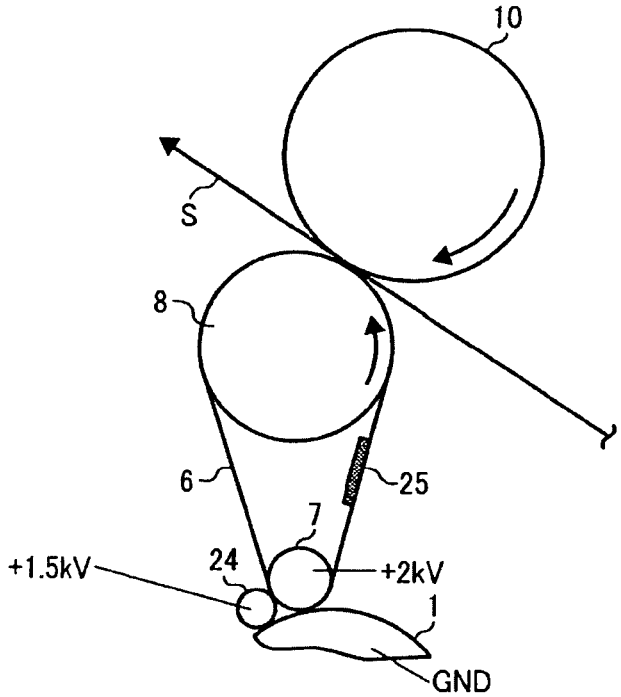
FIG. 29 is a schematic diagram of the transferring/fixing unit and its periphery as another example.

The cooling roller 24 is preferably made of a highly-heat conductive metal in terms of cooling effect, so that the configuration can be such that a bias for neutralizing the surface of the transferring/fixing belt 6 is applied to the cooling roller 24 as shown in FIG. 29 to stably form images as well as cool the photosensitive element 1. A heat source 25 shown in FIGS. 28 and 29 heats the transferring/fixing belt 6.

Figure 20:
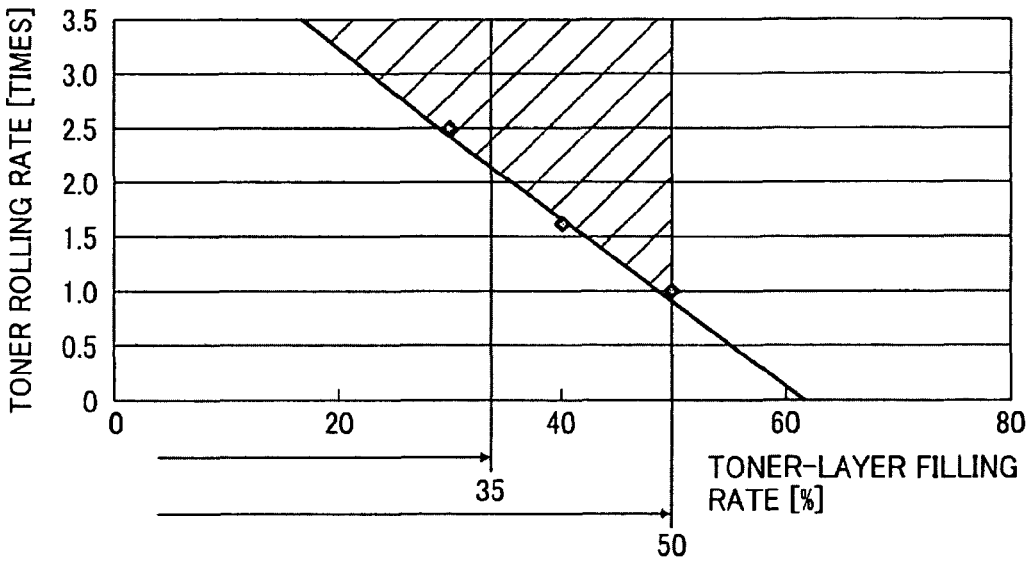
FIG. 20 is a graph representing a relationship between the toner-layer filling rate and the toner rolling rate.

The relationship between the toner-layer filling rate of the developed toner layer and the toner rolling rate of the toner in the transferring and fixing process is explained with reference to FIG. 20. If the toner rolling rate is large even when the toner-layer filling rate is relatively small (hatched area shown in FIG. 20), a sufficiently uniform image can be formed.

Specifically, when the toner-layer filling rate is equal to or lower than 50%, the toner-layer filling rate and the toner rolling rate satisfy $$\text{(toner rolling rate)[times]}>-0.075\times\text{(toner-layer filling rate)[\%]}+4.7.$$

Therefore, even when the toner adhering amount is small, i.e., the toner-layer filling rate is not large enough, a uniform image can be obtained by the rolling effect by the transferring/fixing device 60. The toner-layer filling rate exceeds about 50% in the square filling state, which results in failure of having a sufficient developing potential due to the low optical transparency resulted from generation of toner layer charging at the time of recharging of the photosensitive element 1. Moreover, if the toner-layer filling rate is equal to or lower than 35%, a relationship shown in FIG. 21 cannot be obtained.

Figure 21:
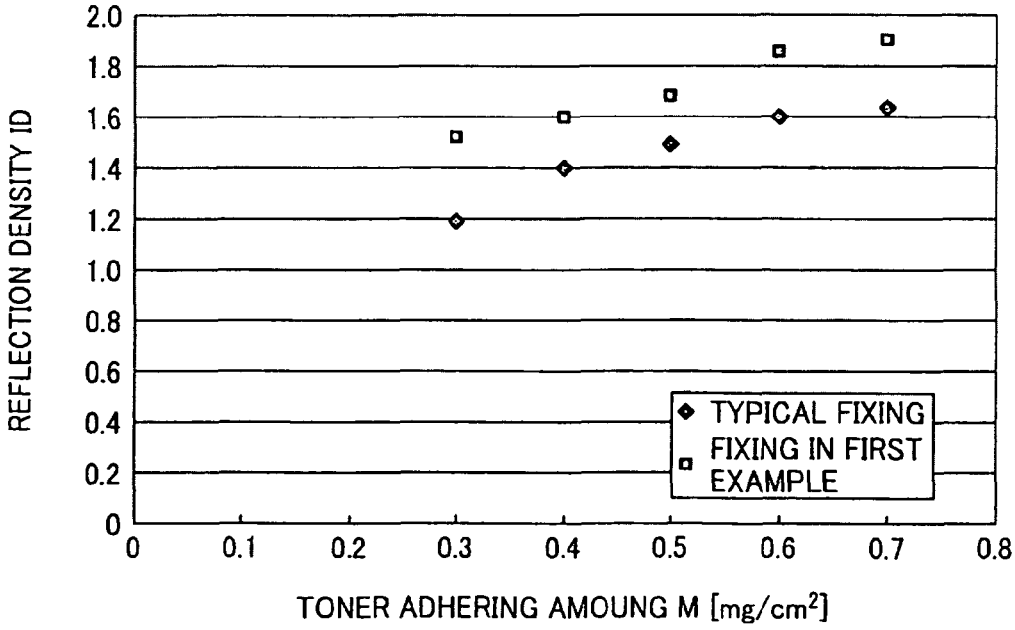
FIG. 21 is a graph representing a relationship between the toner adhering amount and the reflection density.

FIG. 21 is a graph representing the relationship between the toner adhering amount and the reflection density ID for two cases of the normal fixing indicated by solid diamonds and the fixing by using the transferring/fixing device 60 indicated by hollow squares. As shown in FIG. 21, it was found that with the use of the transferring/fixing device 60, sufficiently large reflection density ID that exceeds that in the typical fixing and is practically acceptable level can be obtained even if the toner adhering amount is relatively small.

A developing unit according to a second example is explained with reference to FIGS. 22 to 24, which relates to a flare development. In the developing unit according to the second example, toner can be adhered to the photosensitive element without being affected by the amount of toner previously adhered to the photosensitive element. For obtaining the appropriate post-exposure potential $V_L$ by exposing the photosensitive element on which a toner layer is formed, the light needs to pass through the toner layer and reach the surface of the photosensitive element. The toner is charged negatively in the present example, so that the toner layer is not always present in the perfectly highest density filling state as shown in FIG. 17 because the repulsive force acting between the toner particles. When a toner layer having only one-layer-level thickness is formed on the photosensitive element, the light easily passes through the toner layer in exposure.

Figure 22:
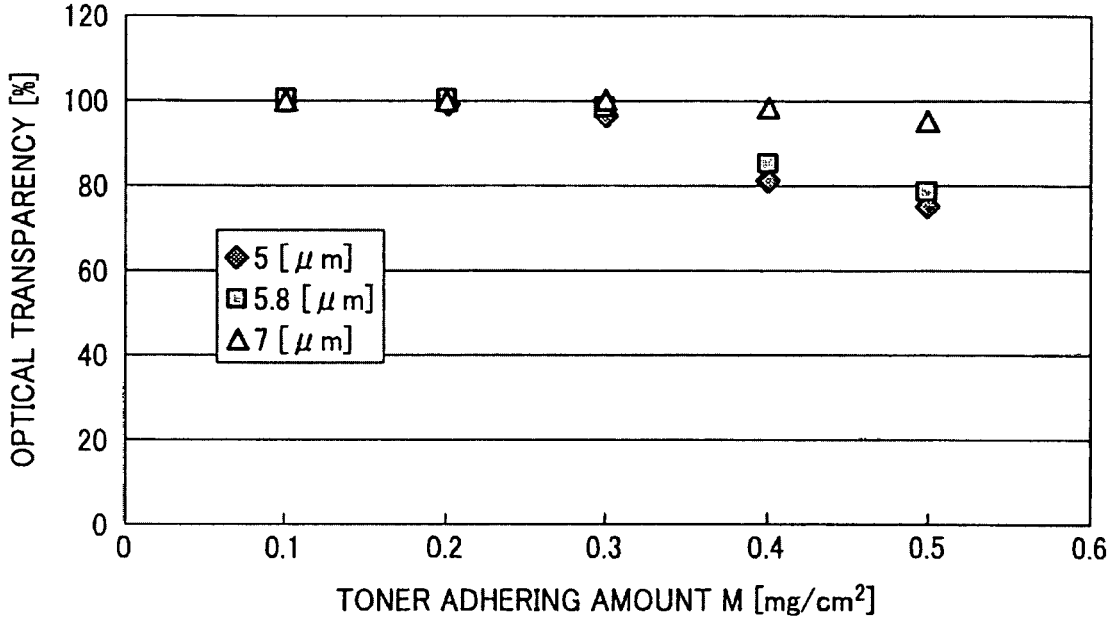
FIG. 22 is a graph representing a relationship between the toner adhering amount and an optical transparency.

FIG. 22 is a graph representing a relationship between a typical toner adhering amount M of the first color toner and the optical transparency (transmitted light quantity) [%] for three different toner particle diameters (5.0, 5.8, and 7.0 micrometers). The influence of the recharging of the photosensitive element needs to be considered for the toner of the second and successive colors. As shown in FIG. 22, the relationship between the toner adhering amount M and the optical transparency changes depending upon the toner particle diameter.

Figure 23:
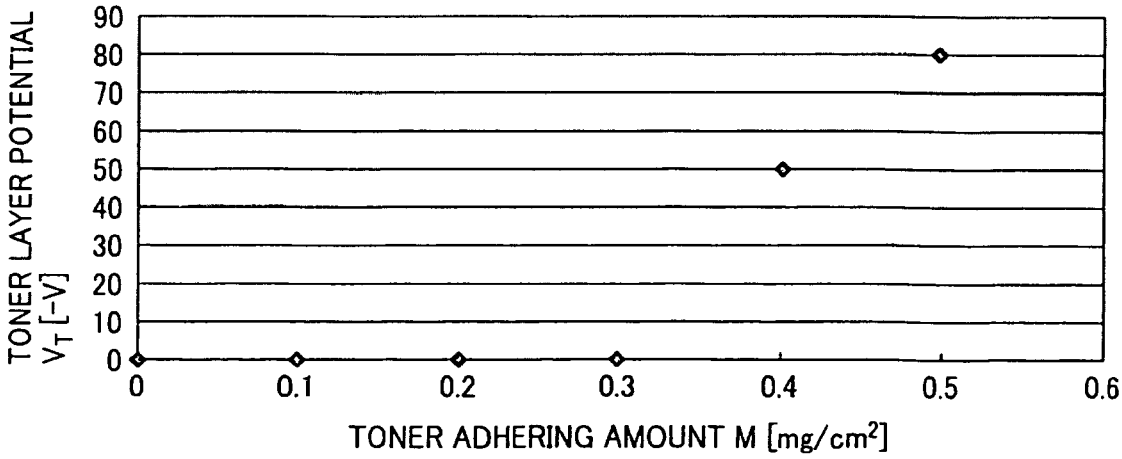
FIG. 23 is a graph representing a relationship between the toner adhering amount and a toner layer potential when a photosensitive element is recharged.

FIG. 23 is a graph representing a relationship between the toner adhering amount M of the first color toner and a toner layer potential $V_T$ (post-exposure average potential) when the photosensitive element is recharged, in which toner having a toner particle diameter of 7 micrometers is used. As shown in FIG. 23, when the toner adhering amount M is equal to or lower than 0.3 [mg/cm$^2$], the toner is hardly charged, i.e., the toner layer potential $V_T$ is almost zero volt. This means that only the photosensitive element is charged, so that the developing potential does not fluctuate depending upon the present or absence of the toner layer, enabling to obtain a uniform image.

Figure 24:
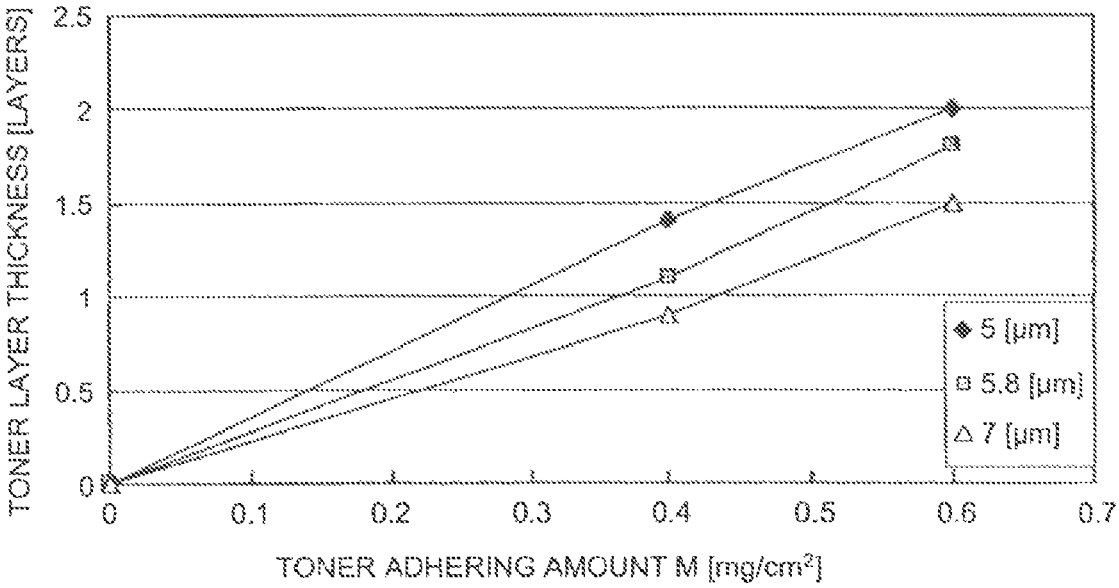
FIG. 24 is a graph representing a relationship between the toner adhering amount and a toner layer thickness.

The relationship between the toner adhering amount M and the toner layer thickness relative to the relationship shown in FIG. 22 is explained referring to FIG. 24. As shown in FIG. 24, when the toner adhering amount M exceeds 0.4 [mg/cm$^2$], one or more layer is present on the photosensitive element, so that the toner is easily charged when the photosensitive element is recharged and the light in the next exposure is blocked. This may affect the following developing process. As shown in FIG. 24, it was found that the relationship between the toner adhering amount M and the toner layer thickness changes depending upon the toner particle diameters. Thus, it was found that the detail condition changes depending upon the diameter, the shape, and the like of the toner, however, a toner layer formed on the photosensitive element preferably has a thickness not exceeding a two-layer-level thickness at most.

A developing unit according to a third example is explained with reference to FIGS. 25 to 27. With the developing unit according to the third example, images can be formed in high quality and an image forming apparatus can be reduced in size compared with the conventional technologies. Moreover, the developing unit can form toner images on the photosensitive element in superimposing manner with less displacement.

The developing unit includes a toner carrier that conveys toner to a latent image carrier to develop an electrostatic latent image formed on the latent image carrier, a toner conveying unit that is arranged to be in contact with or near the toner carrier, and a regulating unit that is arranged on a downstream side of the toner conveying unit in a rotation direction of the toner carrier to be in contact with or near the toner carrier, in which a spatially-periodical electrode pattern P is provided on the toner carrier through an insulating layer 33 to form a time-periodical potential difference between a group of electrodes with odd-numbers (e.g. 37 and 39) (hereinafter, "odd-numbered electrode group") and a group of electrodes with even-numbers 2n (hereinafter, "even-numbered electrode group") with reference to a specific electrode 38. The developing unit can be provided to an electrophotographic image forming apparatus.

Figure 25:
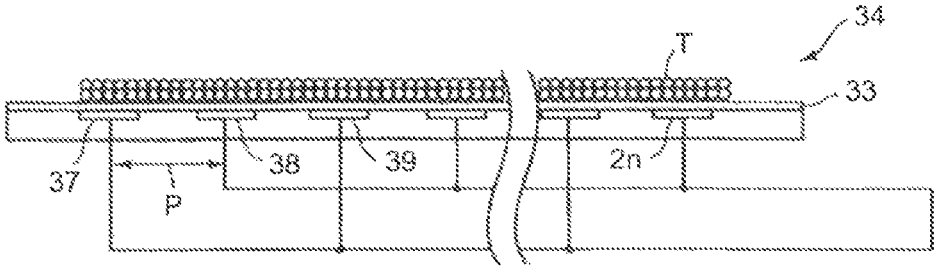
FIGS. 25 and 26 are cross sectional views of a toner carrier according to a third example.
Figure 26:
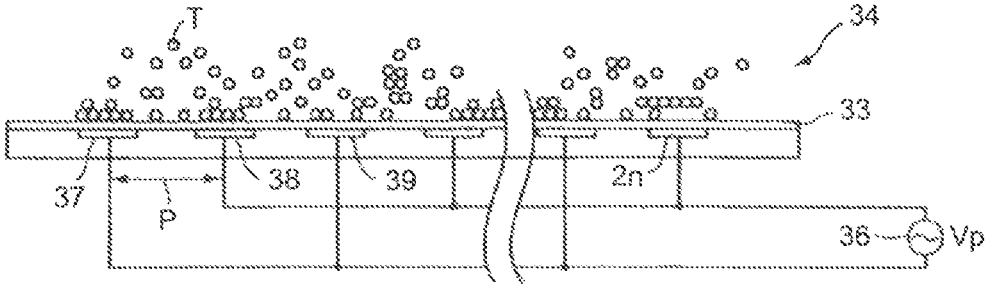
Figure 27:
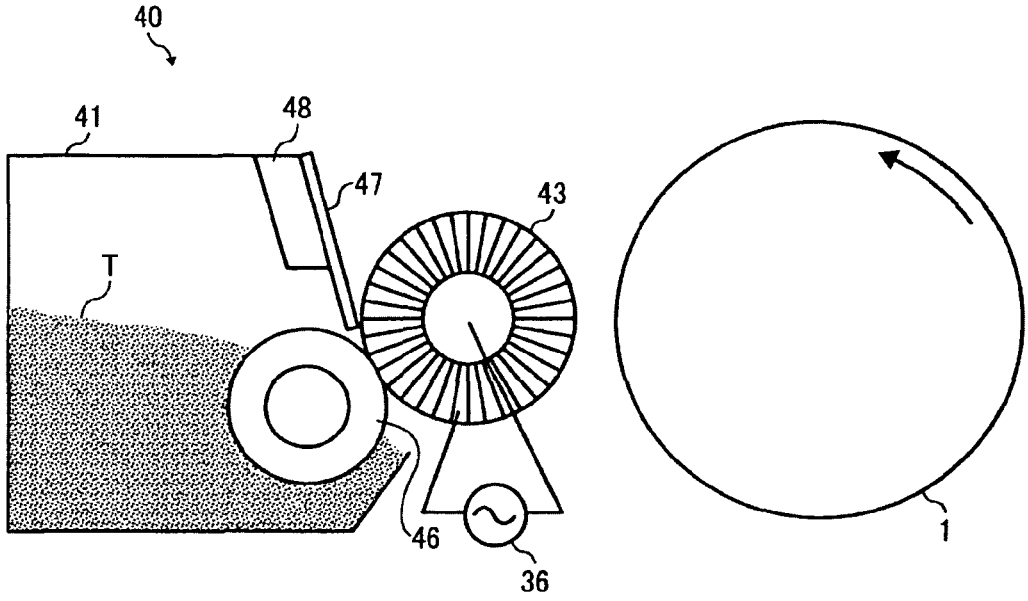
FIG. 27 is a schematic diagram of a developing unit and its periphery according to the third example.

FIGS. 25 and 26 are schematic diagrams of a toner carrier 34, and FIG. 27 is a schematic diagram of a developing unit 40 and its periphery, according to the third example. Two conveying electrodes are provided, which is different from the first example in which three conveying electrodes are provided as shown in FIG. 4. A power source 36 shown in FIGS. 26 and 27 applies AC voltage $V_P$ on the output side to the odd-numbered electrode group and that on the ground side to the even-numbered electrode group as a bias voltage. The voltages applied to the odd-numbered electrode group and the even-numbered electrode group have opposite phases, so that the toner T moves along the electric field formed by the potential difference between the electrodes as shown in FIG. 26 from the state shown in FIG. 25 in which the toner layer is formed.

The toner T basically reciprocates between the electrodes having opposite phases. The developing unit 40 includes a developing casing 41, a developing roller 43, a conveying roller 46, a regulating blade 47, and a regulating blade support unit 48. In the developing unit 40 shown in FIG. 27, a base including the electrodes is formed into an endless form. The base is mechanically rotated, so that the toner T is conveyed while being hopping, thereby developing a latent image. Reliability in conveying the toner T can be improved by rotating the developing roller 43.

Figure 30:
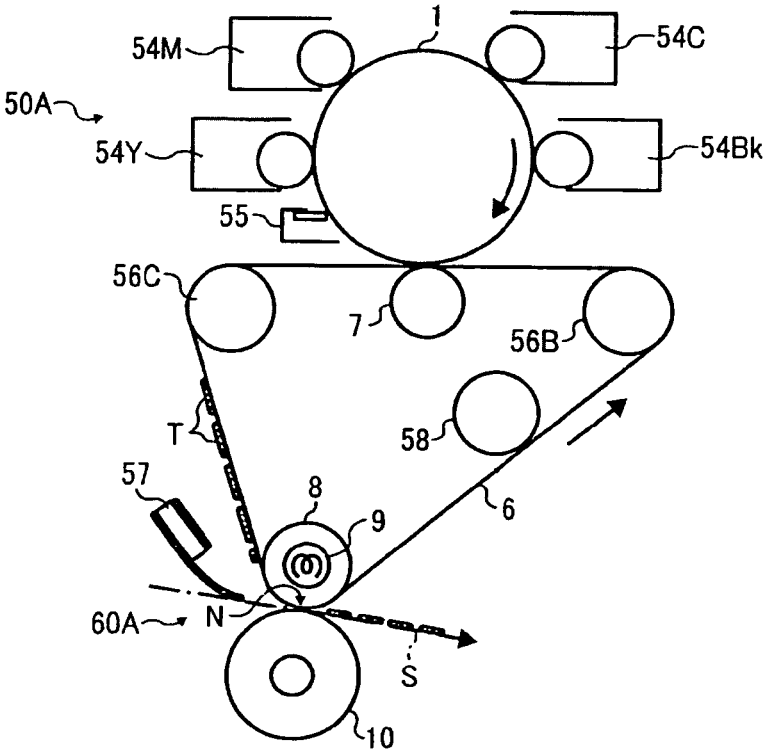
FIG. 30 is a schematic diagram of an image forming apparatus according to another embodiment of the present invention.

FIG. 30 is a schematic diagram of an image forming apparatus according to another embodiment of the present invention, in which a toner image forming device 50A and a transferring/fixing device 60A are used instead of the toner image forming device 50 and the transferring/fixing device 60 of the image forming apparatus shown in FIG. 1.

The toner image forming device 50A includes exposing units (not shown) or writing units (not shown), charging units (not shown), and developing units 54Y, 54M, 54C, and 54K corresponding to the colors of yellow (Y), magenta (M), cyan (C), and black (K), and a cleaning unit 55, which are arranged around the photosensitive element 1.

The transferring/fixing device 60A includes the transferring/fixing belt 6, the heating roller 8 having the built-in heater 9, the pressure roller 10, a heating unit 57, and a uniforming roller 58. The transferring/fixing belt 6 is supported by the transfer bias roller 7, a plurality of rollers 56B and 56C, the heating roller 8, and the uniforming roller 58 in a rotatable manner.

Toner images with different colors are superimposed on the photosensitive element 1 and are transferred onto the transferring/fixing belt 6 at a position where the photosensitive element 1 opposes the transfer bias roller 7.

Thereafter, the toner T of the color toner image carried on the transferring/fixing belt 6 is rolled by heat of the transferring/fixing belt 6 and is transferred onto the sheet S heated by the heating unit 57 at a position of a nip N formed by the heating roller 8 and the pressure roller 10 while being melted and fixed thereon.

According to the image forming apparatus, the surface of the sheet S onto which the color toner image is to be transferred is effectively heated just before being conveyed to the nip N, and the uniforming roller 58 uniforms the temperature distribution in the transferring/fixing belt 6 in the width direction thereof after the image transferring and fixing process. Therefore, energy consumed in the apparatus can be lowered, and a failure in fixing an image to a sheet can be reduced.

According to one aspect of the present invention, uniform images can be formed.

According to another aspect of the present invention, toner images can be surely superimposed on the image carrier.

According to still another aspect of the present invention, cost for image formation can be reduced.

According to still another aspect of the present invention, reliability for developing toner images can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries an image;

a toner image forming unit that includes a charging unit, an exposing unit, and a developing unit, and forms a color toner image on the image carrier by superimposing toner images of at least two colors thereon by using developers of at least two colors through repeated charging and exposing of the image carrier by the charging unit and the exposing unit to form a latent image thereon and developing the latent image by the developing unit;

a transferring/fixing unit configured to contact the image carrier carrying the color toner image so that the color toner image is transferred onto the transferring/fixing unit;

a pressing unit that is in pressure-contact with the transferring/fixing unit to form a nip through which a recording medium is conveyed;

a heating unit that heats the transferring/fixing unit and the recording medium; and a toner-layer filling-rate lowering unit that causes a toner layer of the toner images to be formed on the image carrier so that the toner layer has sufficient optical transparency for the exposing and a toner-layer filling rate is less than or equal to substantially 50%.

2. The image forming apparatus according to claim 1, further comprising:

a toner rolling rate adjusting unit that rolls the color toner image at a toner rolling rate of a predetermined value in accordance with the toner-layer filling rate when the color toner image is transferred to the transferring/fixing unit.

3. The image forming apparatus according to claim 2, wherein the toner-layer filling-rate lowering unit includes a density detecting unit that detects density of the toner layer; and a control unit that controls a developing potential by using at least one of a charge potential, a light quantity in the exposing, and a developing bias based on a signal received from the density detecting unit.

4. The image forming apparatus according to claim 3, wherein the control unit further controls a temperature of the heating unit and a pressure applied to the transferring/fixing unit when the pressure unit is brought into pressure-contact with the transferring/fixing unit.

5. The image forming apparatus according to claim 4, wherein the control unit includes a central processing unit, a read only memory, and a random access memory, the control unit configured to control the developing potential via a computer program or computer data stored in the read only memory based on signals received from the density detecting unit.

6. The image forming apparatus according to claim 2, wherein, when the toner-layer filling rate is equal to or lower than 50%, the toner-layer filling rate and the toner rolling rate satisfy (toner rolling rate)[times]>−0.075×(toner-layer filling rate)[%]+4.7.

7. The image forming apparatus according to claim 2, wherein, when the toner-layer filling rate is equal to or lower than 35%, the toner-layer filling rate and the toner rolling rate satisfy (toner rolling rate)[times]>−0.075×(toner-layer filling rate)[%]+4.7.

8. The image forming apparatus according to claim 2, wherein the toner rolling rate ($R_{RL}$) satisfies:

$$(R_{RL})^2=a\times(L_{TF}/L_T)^2,$$

where "a" is a constant number, and $L_T$ and $L_{TF}$ are widths of the toner layer before and after being fixed by the transferring/fixing unit, respectively.

9. The image forming apparatus according to claim 1, wherein the developing unit develops the latent image by causing toner to adhere to the image carrier, is arranged opposing the image carrier, and includes a conveying unit that includes a plurality of electrodes for generating a progressive-wave electrical field for moving the toner.

10. The image forming apparatus according to claim 1, wherein the developing unit includes a toner carrier, is arranged opposing the image carrier, and is provided with a spatially-periodical electrode pattern of electrodes on the toner carrier via an insulating layer to form a time-periodical potential difference between an odd-numbered electrode group and an even-numbered electrode group of the electrodes with reference to one of the electrodes.

11. The image forming apparatus according to claim 1, wherein a toner of the developer has a volume average particle diameter of equal to or larger than 5 micrometers.

12. An image forming method comprising:

forming a color toner image on an image carrier by superimposing toner images of at least two colors thereon by using developers of at least two colors through repeated charging and exposing of the image carrier by a charging unit and an exposing unit to form a latent image thereon and developing the latent image by a developing unit;

transferring the color toner image from the image carrier to a transferring/fixing unit by at least one of heat and pressure; and causing a toner layer of the toner images to be formed on the image carrier so that the toner layer has sufficient optical transparency for the exposing and a toner-layer filling rate is less than or equal to substantially 50%.

13. The image forming method according to claim 12, wherein the forming includes rolling the color toner image at a toner rolling rate of a predetermined value in accordance with the toner-layer filling rate when the color toner image is transferred from the image carrier to the transferring/fixing unit.

14. The image forming method according to claim 13, further comprising:

detecting density of the toner layer; and controlling a developing potential by using at least one of a charge potential, a light quantity in the exposing, and a developing bias based on the density detected by the density detecting unit.

15. The image forming method according to claim 13, wherein, when the toner-layer filling rate is equal to or lower than 50%, the toner-layer filling rate and the toner rolling rate satisfy (toner rolling rate)[times]>−0.075×(toner-layer filling rate)[%]+4.7.

16. The image forming method according to claim 13, wherein, when the toner-layer filling rate is equal to or lower than 35%, the toner-layer filling rate and the toner rolling rate satisfy $$\text{(toner rolling rate)[times]} > -0.075 \times \text{(toner-layer filling rate)[\%]} + 4.7.$$

17. The image forming method according to claim 13, wherein the toner rolling rate ($R_{RL}$) satisfies:

$$(R_{RL})^2 = a \times (L_{TF}/L_T)^2,$$

where "a" is a constant number, and $L_T$ and $L_{TF}$ are widths of the toner layer before and after being fixed by the transferring/fixing unit, respectively.

18. The image forming method according to claim 12, wherein the developing unit develops the latent image by causing toner to adhere to the image carrier, is arranged opposing the image carrier, and includes a conveying unit that includes a plurality of electrodes for generating a progressive-wave electrical field for moving the toner.

19. The image forming method according to claim 12, wherein the developing unit includes a toner carrier, is arranged opposing the image carrier, and is provided with a spatially-periodical electrode pattern of electrodes on the toner carrier via an insulating layer to form a time-periodical potential difference between an odd-numbered electrode group and an even-numbered electrode group of the electrodes with reference to one of the electrodes.

20. The image forming method according to claim 12, wherein a toner of the developer has a volume average particle diameter of equal to or larger than 5 micrometers.

* * * * *